US007609990B2

(12) United States Patent
Maeda et al.

(10) Patent No.: US 7,609,990 B2
(45) Date of Patent: Oct. 27, 2009

(54) IMAGE FORMING APPARATUS THAT PREVENTS TONER FROM BEING JETTED WHEN CLEANER BLADE OR SEALING MEMBER IS SEPARATED FROM IMAGE CARRIER

(75) Inventors: Masahiro Maeda, Shiojiri (JP); Yoichi Yamada, Shiojiri (JP); Takatomo Fukumoto, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 428 days.

(21) Appl. No.: 11/539,097

(22) Filed: Oct. 5, 2006

(65) Prior Publication Data

US 2007/0230989 A1 Oct. 4, 2007

(30) Foreign Application Priority Data

| | | |
|---|---|---|
| Oct. 6, 2005 | (JP) | 2005-293328 |
| Oct. 6, 2005 | (JP) | 2005-293329 |
| Oct. 6, 2005 | (JP) | 2005-293330 |
| Oct. 6, 2005 | (JP) | 2005-293331 |
| Oct. 6, 2005 | (JP) | 2005-293332 |

(51) Int. Cl.
*G03G 21/20* (2006.01)
*G03G 15/16* (2006.01)

(52) U.S. Cl. ..... 399/92; 399/101

(58) Field of Classification Search ..... 399/92, 399/93, 98, 101, 343, 350
See application file for complete search history.

(56) References Cited

U.S. PATENT DOCUMENTS

| | | | | |
|---|---|---|---|---|
| 5,298,953 | A * | 3/1994 | Lindblad et al. | 399/101 |
| 6,917,773 | B2 * | 7/2005 | Maeda et al. | 399/92 |
| 7,139,502 | B2 * | 11/2006 | Koishi et al. | 399/93 |
| 2003/0235428 | A1 * | 12/2003 | Suzuki et al. | 399/107 |
| 2004/0141780 | A1 * | 7/2004 | Osawa | 399/350 |

FOREIGN PATENT DOCUMENTS

| | | |
|---|---|---|
| JP | 07-121037 | 5/1995 |
| JP | 2004-157285 | 6/2004 |

* cited by examiner

*Primary Examiner*—Sandra L Brase
(74) *Attorney, Agent, or Firm*—Hogan & Hartson LLP

(57) ABSTRACT

A first rotary image carrier is adapted to support a toner image obtained by developing an electrostatic latent image formed thereon. A second rotary image carrier is adapted to support, on a toner supporting face thereof, the toner image which has been primarily transferred from the first rotary image carrier and is to be secondarily transferred onto a recording medium. A cleaner housing has wall members defining a housing space, a first one of which is formed with a first ventilation hole. A blade member is disposed in the housing space and configured to separatably come in contact with the second rotary image carrier to scrape off toner remaining thereon. A sealing member is disposed in the housing space and configured to separatably come in contact with the second rotary image carrier to form a closed space together with the blade member. An air duct, a part of which is formed by an outer face of at least one of the wall members of the cleaner housing, communicates with the housing space through the first ventilation hole.

16 Claims, 13 Drawing Sheets

IMAGE FORMING APPARATUS THAT PREVENTS TONER FROM BEING JETTED WHEN CLEANER BLADE OR SEALING MEMBER IS SEPARATED FROM IMAGE CARRIER

BACKGROUND

1. Field of the Invention

The present invention relates to an image forming apparatus, and more particularly to an image forming apparatus having a structure designed in such a way that a cleaner blade and a seal disposed for scraping out, removing and recovering toner remaining on the surface of an image carrier is separated from the surface of the image carrier.

2. Related Art

An electrophotographic image forming apparatus in which an electrostatic latent image based on image data is formed by irradiating the surface of an image carrier manufactured by a photosensitive member has been hitherto known. In the image forming apparatus, the electrostatic latent image is developed by a developing device so that a toner image is formed on the surface of the image carrier and transferred to a recording medium such as paper to obtain an image.

Such an image forming apparatus comprises: a first image carrier on which an electrostatic latent image is formed and capable of carrying a toner image obtained by developing the electrostatic latent image; and a second image carrier provided at an intermediate position between the first image carrier and a transfer position where the toner image is transferred to the recording medium, so that the toner image on the surface of the first image carrier is received thereon (primarily transferred), and is then secondarily transferred on the recording medium. In this case, for instance, the toner image composed of various colors of the toner formed on the surface of the first image carrier is superposed on the surface of the second image carrier so that a desired toner image such as a color image can be formed. After that, the toner image is transferred to the recording medium such as paper from the surface of the second image carrier, so that a final image can be obtained.

As described above, in the image forming apparatus provided with the second image carrier, the toner remaining on the surface thereof is removed and recovered for each transfer operation of the toner image on the surfaces of the first and second image carriers to ensure the quality of the electrostatic latent image or the toner image.

Since the toner image obtained by developing the electrostatic latent image is then transferred on the surface of the first image carrier, a cleaner blade and a sealing member for removing and recovering the residual toner are disposed in a state that the cleaner and the sealing member always comes into slide contact with the surface of the first image carrier. However, on the surface of the second image carrier, for instance, when the color image is formed, the toner images are superposed on the surface of the second image carrier, and then, transferred to the recording medium.

Accordingly, as shown in FIG. 21, a cleaner blade 522 or a sealing member 523 in a state that is separated from the surface of a second image carrier 516 is pivoted in the direction of an arrow mark as required to come into slide contact with the surface of the second image carrier so as to scrape out toner remaining on the surface of the second image carrier 516 in a cleaner housing 563 in the direction shown by an arrow mark of a dashed line, so that the removed toner is recovered. A member 553 is a roller that rotates the second image carrier 516 and serves as a backup member of the cleaner blade 522 or the sealing member 523. Such a structure is disclosed in Japanese Patent Publication Nos. 2004-157285A (JP-A-2004-157285) and 7-121037A (JP-A-7-121037), for instance.

In such a structure, when the cleaner blade 522 comes into slide contact with the surface of the second image carrier 516 to scrape out the residual toner, the toner to be removed and recovered temporarily lifts in the cleaner housing 563, what is called a toner cloud is generated. The toner cloud is floating toner, and falls and settles after a certain time period elapses. Therefore, when an image forming operation is carried out at a usual speed or so, even if the cleaner blade 522 or the sealing member 523 is separated from the surface of the second image carrier 516, the floating toner is settled until the cleaner blade or the sealing member is separated from the surface of the image carrier so that the floating toner hardly leaks outside the cleaner housing 563 as a closed space.

However, with a high-speed operation of an image formation in recent years, as a time period during which the cleaner blade 522 or the sealing member 523 is separated from the surface of the second image carrier 516, a sufficient time necessary for settling the toner cloud is hardly ensured. Namely, there is an anxious that the cleaner blade 522 or the sealing member 523 is separated from the surface of the second image carrier 516 before the toner cloud is settled to open the closed space, and accordingly, the floating toner leaks outside the cleaner housing 563 to contaminate a neighborhood therewith. For instance, when the cleaner blade 522 or the sealing member 523 is pivoted so as to be separated from the surface of the second image carrier 516, pressure instantaneously rises in the cleaner housing to generate an air flow jetted to an outer part. Thus, the floating toner may possibly leak outside the cleaner housing 563. Accordingly, the toner that does not originally exist in the toner image formed on the first and second image carriers is mixed and its color is mixed, so that the quality of the image is deteriorated or the floating toner leaking in an apparatus main body is accumulated in a periphery member to contaminate a periphery therewith. Thus, a maintenance work is difficult. Further, when a detector, what is called a patch sensor disposed to maintain the high quality of the image and detect the density of the toner image, is contaminated, the quality of the image is deteriorated.

SUMMARY

It is therefore one advantageous aspect of the invention is to provide an image forming apparatus capable of being operated at high speed without a contamination in an apparatus main body by avoiding a large quantity of the floating toner of toner cloud from being jetted from a cleaner housing when a cleaner blade or a sealing member is separated from the surface of an image carrier.

According to one aspect of the invention, there is provided an image forming apparatus, comprising:

a first rotary image carrier, adapted to support a toner image obtained by developing an electrostatic latent image formed thereon;

a second rotary image carrier, adapted to support, on a toner supporting face thereof the toner image which has been primarily transferred from the first rotary image carrier and is to be secondarily transferred onto a recording medium;

a cleaner housing, having wall members defining a housing space, a first one of which is formed with a first ventilation hole;

a blade member, disposed in the housing space and configured to separatably come in contact with the second rotary image carrier to scrape off toner remaining thereon;

a sealing member, disposed in the housing space and configured to separatably come in contact with the second rotary image carrier to form a closed space together with the blade member; and an air duct, a part of which is formed by an outer face of at least one of the wall members of the cleaner housing, and communicating with the housing space through the first ventilation hole.

The air duct may be an exhausting duct of the image forming apparatus.

The image forming apparatus may further comprise a toner flow limiter, provided in the air duct and adapted to limit a flow of toner flowing out of the housing space.

The toner flow limiter may be a filter adapted to catch toner.

The first ventilation hole may be provided at a position opposing to a tip end of the blade member when the blade member comes in contact with the second rotary image carrier.

The toner flow limiter may be an electric field generator operable to generate an electric field adapted to attract toner in the housing space, and to cause the absorbed toner to be attached on an inner face of the air duct.

The toner flow limiter may be an electric field generator operable to generate an electric field adapted to prevent toner within the cleaner housing from passing through the first ventilation hole.

The image forming apparatus may further comprise:

a sensor, disposed in an upstream side of the cleaner housing relative to a rotary direction of the second rotary image carrier, and operable to detect a density of toner on the second rotary image carrier;

a sensor support member, disposed in the vicinity of the first ventilation hole and supporting the sensor; and a plate member, provided with the support member and forming a part of the air duct.

A cleaner angle may be defined as an angle between an extending direction of a tip end portion of the blade member when the blade member comes in contact with the second rotary image carrier and a tangential line of the second rotary image carrier at the position that the blade member comes in contact with the second rotary image carrier. The first ventilation hole may be formed so as to intersect the tangential line and a line extending in a direction angled from the tangential line by at least the cleaner angle.

The image forming apparatus may further comprise a seal support member, supporting the seal member and forming a part of the first one of the wall members of the cleaner housing.

The image forming apparatus may further comprise a filter, covering the first ventilation hole and adapted to catch toner.

The image forming apparatus may further comprise a plate member, provided in the housing space and extending toward the first ventilation hole.

The image forming apparatus may further comprise:

a seal support member, supporting the seal member and forming a part of the first one of the wall members of the cleaner housing formed with the first ventilation hole; and a blade support member, disposed in the housing space and supporting the blade member.

The plate member may be provided with at least one of the seal support member and the blade support member.

The sensor support member may comprise a plate member extending toward the toner supporting face of the second rotary image carrier.

A second one of the wall members of the cleaner housing may be formed with a second ventilation hole communicating the air duct and the housing space therethrough.

The second ventilation hole may be formed at such a position that a line connecting the first ventilation hole and the second ventilation hole becomes a tangential line of the second rotary image carrier.

The image forming apparatus may further comprise a plate member extending in a direction parallel to the line connecting the first ventilation hole and the second ventilation hole.

The image forming apparatus may further comprise a filter, covering the second ventilation hole and adapted to catch toner.

DETAILED DESCRIPTION OF EXEMPLARY EMBODIMENTS

Exemplary embodiments of the invention will be described below in detail with reference to the accompanying drawings.

Figure 1:
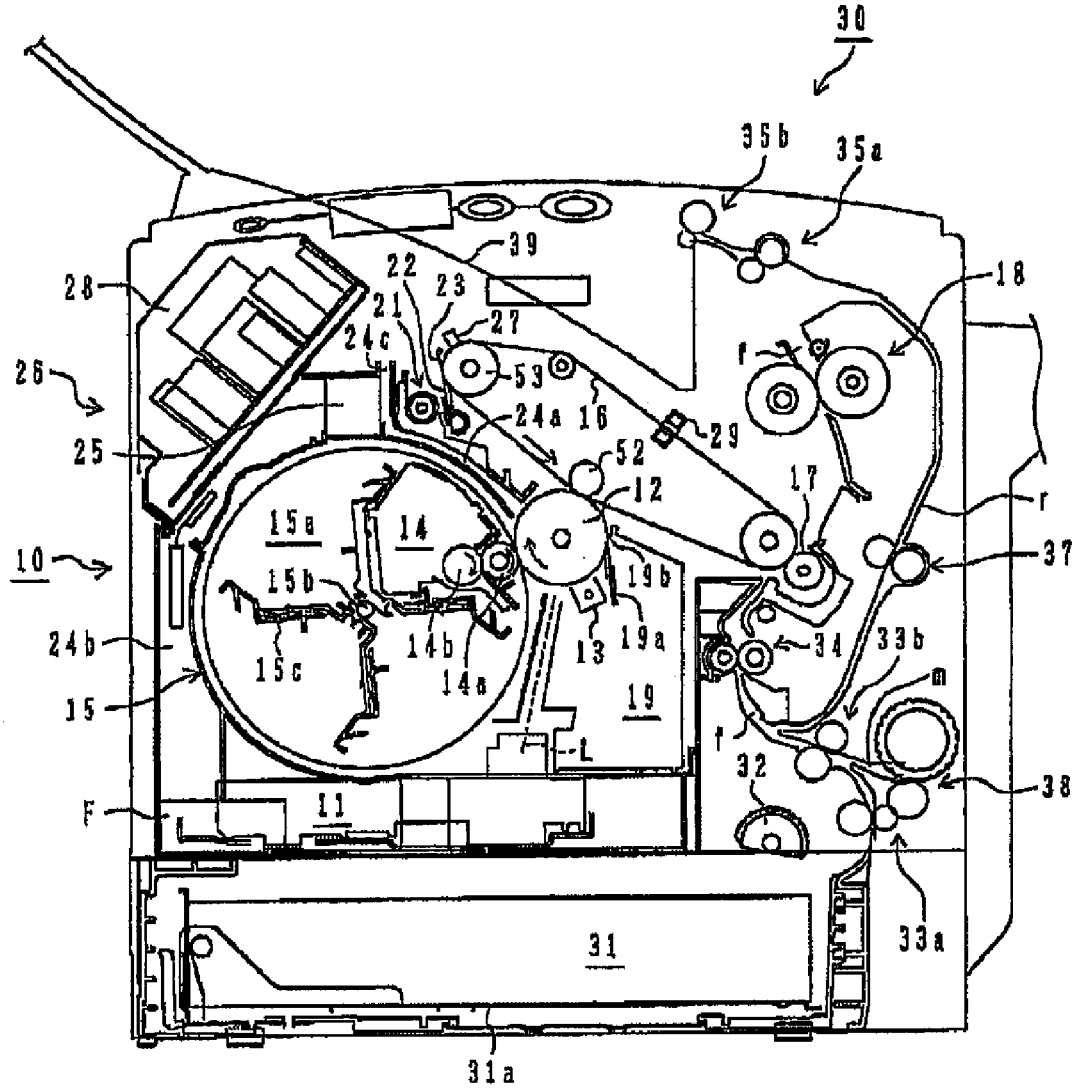
FIG. 1 is a section view showing an internal configuration of an image forming apparatus according to a first embodiment of the invention.
Figure 2:
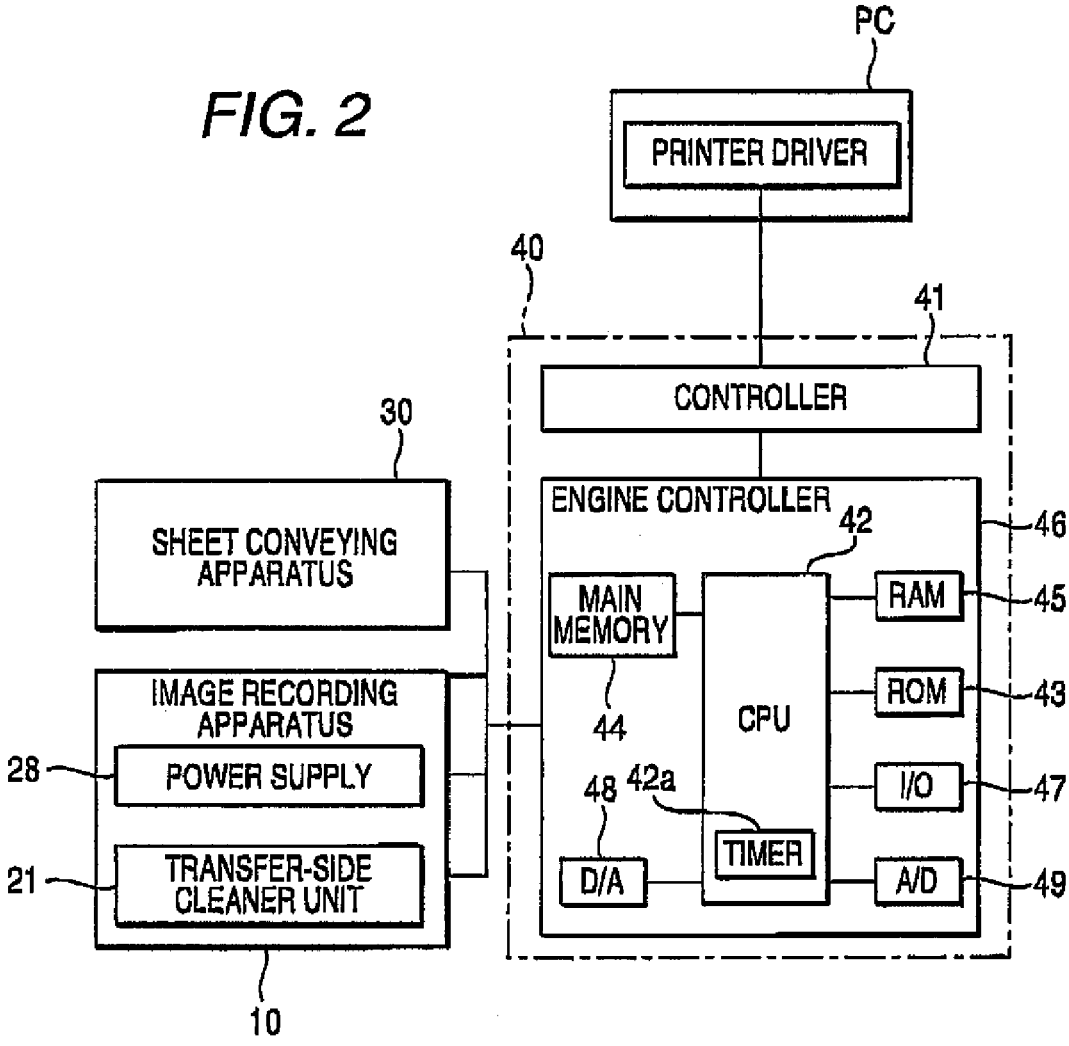
FIG. 2 is a block diagram showing a control system in the image forming apparatus.

In FIGS. 1 and 2, an image forming apparatus is a printer adapted to be connected to an external device such as a personal computer PC for generating and outputting images such as characters. The image forming apparatus comprises: an image recording apparatus 10 for receiving image data such as characters whose images are formed and for recording the images on at least one side face of a recording sheet (a recording medium) by an electrophotographic technique; a sheet conveying apparatus 30 for conveying loaded recording sheets to the image recording apparatus 10, and for ejecting the recording sheets which have been subjected to the image recording operation; and a control unit 40 for integrally controlling the image recording apparatus 10 and the sheet conveying apparatus 30, thereby a print out of an image is performed in the recording sheet.

Briefly described, the image recording apparatus 10 comprises: a laser beam scanner 11 for scanning by a laser beam L in accordance with the image data, a photosensitive drum (a first image carrier) 12 configured such that an electrostatic latent image is formed on the surface thereof based on the image data obtained by irradiating with the laser beam L from the laser beam scanner 11; a charger 13 for charging the surface of the outer periphery of the photosensitive drum 12 so as to allow the formation of the electrostatic latent image; development cartridges 14 (only one of them is illustrated) for respectively accommodating toners of yellow (Y), cyan (C), magenta (M) and black (K) and frictionally charging the accommodated toners to selectively stick (carry) the toner onto the photosensitive drum 12 to develop the electrostatic latent image on the surface of the photosensitive drum 12 as a toner image; a development rotary unit 15 that accommodates the development cartridges 14 in respective chambers 15*a* so as to be rotatable about a rotary shaft 15*b*; an intermediate transfer belt (a second image carrier) 16 that receives a toner image developed on the photosensitive drum 12 to carry the primarily transferred toner image (a monochromatic or a color image) which is to be transferred to a recording sheet; a transfer roller 17 for nipping the conveyed recording sheet together with the intermediate transfer belt 16 so that the toner image carried by the intermediate transfer belt 16 is secondarily transferred to the recording sheet while conveying the recording sheet to a downstream side; a pair of fusing rollers 18 for heating and nipping the recording sheet to fuse the secondarily transferred toner image with the recoding sheet while conveying the recording sheet to a further downstream side; a development-side cleaner unit 19 for recovering and storing the toner remaining on the surface of the photosensitive drum 12 by a cleaner blade 19*a*; a transfer-side cleaner unit 21 for recovering and storing the toner remaining on the surface of the intermediate transfer belt 16 by a cleaner blade 22; and an exhausting unit 26 in which a suction fan F especially sucks a downstream side in the rotating direction of the photosensitive drum 12 (a developing roller 14*a*) through exhaust ducts 24*a* and 24*b* disposed to cover the outer peripheral side of the development rotary unit 15 so that the toner scattering in the periphery is collected by a filter 25 disposed between the exhaust ducts 24*a* and 24*b*.

Thus, in the image recording apparatus 10, the electrostatic latent image based on the image data and formed on the surface of the photosensitive drum 12 by the laser beam scanner 11 is toner-developed by the development cartridge 14 in the development rotary unit 15 activated in accordance with the image data. Then, the toner image on the photosensitive drum 12 is primarily transferred to the intermediate transfer belt 16, secondarily transferred and recorded to the recording sheet conveyed by the sheet conveying apparatus 30 and then, heated and nipped by the pair of fusing rollers 18 to form the image. At this time, for instance, when the development cartridges 14 for accommodating the toners of colors of yellow (Y), cyan (C), magenta (M) and black (K) are housed in the development rotary unit 15, the colors of the toners for developing the electrostatic latent image on the photosensitive drum 2 are changed to superpose or select the toners of respective colors on the basis of the received image data so that the color image or the monochromatic image can be formed on the recording sheet. Further, when all the cartridges 14 for accommodating the toner of the same color, for instance, black (K) are housed in the development rotary unit 15, the image forming apparatus can be used as an exclusive machine in which the development cartridges 14 for developing the electrostatic latent image on the photosensitive drum 12 are sequentially changed to continuously print and form the monochromatic image on the recording sheet.

Briefly described, the sheet conveying apparatus 30 comprises: a sheet cassette 31 detachably set to the lower part of an apparatus main body to accommodate a plurality of recording sheets therein; a pickup roller 32 that comes into pressure-contact with a bundle of recording sheets elevated by a hopper plate 31*a* on the bottom surface of the sheet cassette 31 and rotates to pull out an uppermost recording sheet and supply the same to a conveying path f; pairs of relay conveying rollers 33*a* and 33*b* for receiving the recording sheet supplied from the pickup roller 32 to convey the recording sheet to a further downstream conveying path f by nipping the recording sheet between them; a pair of resist rollers 34 for receiving the recording sheet in the conveying path f conveyed by the pairs of relay conveying rollers 33*a* and 33*b* by nipping the recording sheet between them so that the sheet is conveyed to an image recording and forming position by the intermediate transfer belt 16 and the transfer roller 17 of the image recording apparatus 10; and pairs of sheet delivery rollers 35*a* and 35*b* for receiving the recording sheet that is conveyed in the conveying path f via the nipping part between the intermediate transfer belt 16 and the transfer roller 17 and the nipping part between the pair of the fusing rollers 18 from the pair of the resist rollers 34 to have a fused image, and for delivering the recording sheets on a sheet ejection tray 39 in the upper part of the apparatus main body. Since the intermediate transfer belt 16 and the transfer roller 17 or the pair of fusing rollers 18 of the image recording apparatus also have functions for conveying the recording sheet, they form a part of the sheet conveying apparatus 30.

Thus, in the sheet conveying apparatus 30, after the recording sheet pulled out from the sheet cassette 31 by the pickup roller 32 is delivered to the pair of the resist rollers 34 through the pairs of the relay conveying rollers 33*a* and 33*b*, the pair of the resist rollers 34 feeds the recording sheet to the image recording and forming position with which the intermediate transfer belt 16 and the transfer roller 17 come into pressure contact so as to synchronize with the operation of the image recording apparatus 10. The recording sheet on which the toner image on the intermediate transfer belt 16 is transferred and recorded and fused by the pair of the fusing rollers 18 is received by the pairs of the sheet delivery rollers 35*a* and 35*b* to eject the recording sheets on the sheet ejection tray 39.

Here, the sheet conveying apparatus 30 comprises a re-conveying path r for reversing the recording sheet having the image formed on its one side and feeding the recording sheet to the conveying path f in the upstream side of the pair of the resist rollers 34 and a pair of intermediate conveying rollers 37 disposed in the path r. The pairs of the sheet delivery rollers 35*a* and 35*b* are reversed so that the recording sheet fed to the re-conveying path r is received by the pair of the intermediate conveying rollers 37 and delivered to the pair of the resist rollers 34. Thus, the image can be formed on both sides of the recording sheet. Further, the sheet conveying apparatus 30 comprises a manual feeding path m for feeding a manually fed recording sheet to the conveying path f in the upstream side of the pair of the resist rollers 34 and a pair of manual feeding rollers 38 disposed in the path m. The recording sheet fed to the manual feeding path m is received by the pair of the manual feeding rollers 38 and delivered to the pair of the resist rollers 34, so that the image can be formed on one surface or both the surfaces of the recording sheet.

Briefly stated, the control unit 40 comprises: a controller 41 in which a CPU not shown in the drawing performs various kinds of operations in accordance with programs stored in a memory to communicate various kinds of information such as a print instruction between a printer driver of the personal computer PC and the CPU, and receives image data such as a text for forming the image on the recording sheet to temporarily store the image data in the memory not shown in the drawing; and an engine controller 46 in which a CPU 42 receives the image data, for instance, for each page from the controller 41 in accordance with a control program stored in a ROM 43, temporarily stores the image data in a main memory 44 while using a RAM 45 as a work area at the same time and communicates various kinds of information between the image recording apparatus 10 and the sheet conveying apparatus 30 and the CPU 42 to form the image based on the image data on the recording sheet. The controller 41 and the engine controller 46 are formed on a circuit board mounted in the apparatus main body.

Thus, in the control unit 40, since the image data (an image information signal) received from the personal computer PC is what is called RGB data of red (R), green (G) and blue (B), the controller 41 converts the RGB data to image data of what is called YMCK data of yellow (Y), magenta (M), cyan (C) and black (K) that can be printed, reads the image data for instance, for each page from the memory, and delivers the image data to the engine controller 46. The engine controller 46 controls the image recording apparatus 10 and the sheet conveying apparatus 30 on the basis of the image data to form the image on the recording sheet.

In the control unit 40, the CPU 42 uses an internal timer function 42*a* to count various kinds of time periods so as to operate respectively the parts of the apparatus in an optimum condition and control an image formation. The control unit 40 is connected to the image recording apparatus 10 and the sheet conveying apparatus 30 through an I/O interface 47 so that various kinds of information can be communicated between the image recording apparatus 10 and the sheet conveying apparatus 30 and the engine controller 41 or the engine controller 46. The control unit 40 includes a D/A converter 48 and an A/D converter 49 for converting a digital signal (D) to an analog signal (A) or vice versa so that the engine controller 46 can respectively process various kinds of information communicated between the image recording apparatus 10 and the sheet conveying apparatus 30 and the controller 41.

Figure 3A:
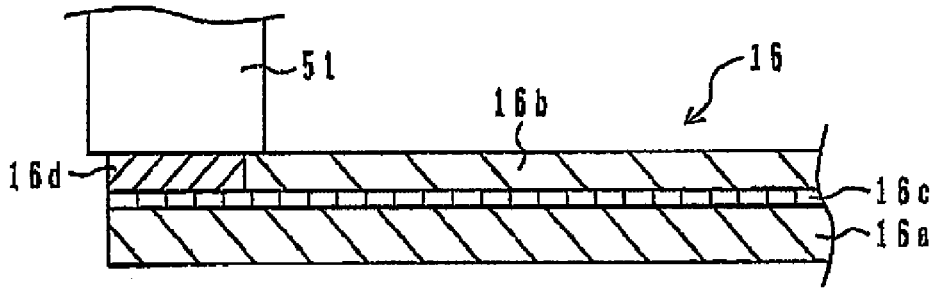
FIG. 3A is a section view showing a structure of an intermediate transfer belt in the image forming apparatus.

In the image forming apparatus, since the toner image on the surface of the photosensitive drum 12 is transferred to the recording sheet through the intermediate transfer belt 16, the intermediate transfer belt 16 needs to carry the toner image highly accurately formed and transfer the toner image to the recording sheet with high quality like the photosensitive drum 12. Therefore, as shown in FIG. 3A, in the intermediate transfer belt 16, a conductive layer 16*c* is formed on an entire surface between a belt main body 16*a* and a resister layer 16*b* and an electrode part 16*d* electrically connected to the conductive layer 16*c* is formed and exposed in all the periphery in place of the resister layer 16*b* in the side edge thereof. An electrode roller 51 is designed to come into pressure-contact with the electrode part 16*d* and apply a positive voltage thereto so as to positively adsorb (attract) the toner electrified to a negative potential by the frictional electrification in the development cartridge 14 so that the toner can be held over the entire surface without unevenness.

Figure 3B:
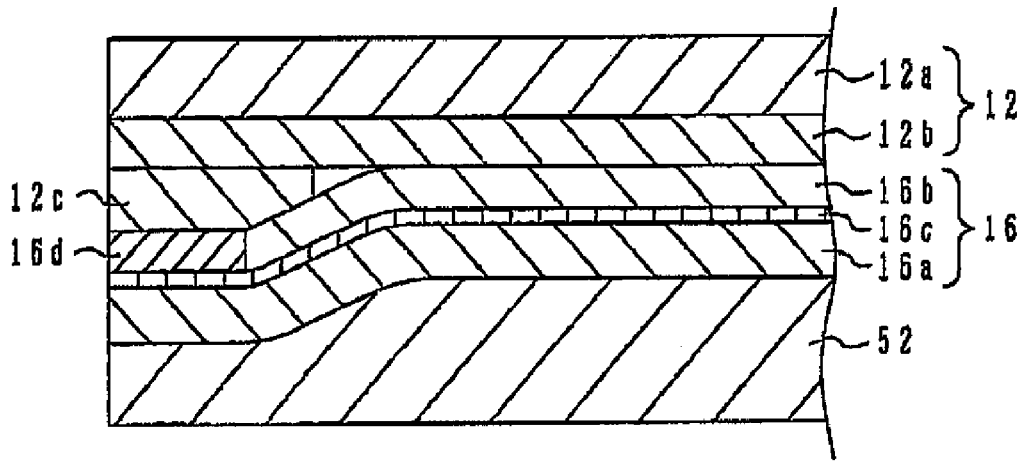
FIG. 3B is a section view showing a surface structure of a photosensitive drum in the image forming apparatus.

As shown in FIG. 3B, since the intermediate transfer belt 16 is pressed by a primary transfer roller 52 from a back side thereof to come into pressure-contact with the photosensitive drum 12, the electrode part 16*d* exposed in the side edge of the intermediate transfer belt 16 comes into contact with a photosensitive layer 12*b* on the surface of a conductive part 12*a*. When pin holes exist in the photosensitive layer 12*b*, there is an anxious that a current may possibly leak to the intermediate transfer belt 16 that is to be originally insulated from the photosensitive drum 12. Accordingly, an insulating part 12*c* that can be interposed with an adequate area relative to the electrode part 16*d* is formed throughout an entire periphery.

Further, in the image forming apparatus, since the quality of the toner image carried by the intermediate transfer belt 16 gives an influence on the quality of the image formed on the recording sheet, the density of the toner image is designed to be checked at an arbitrary timing in order to recognize the quality of a development or the quality of transfer from the toner image before the image is transferred to the recording sheet. For instance, a so-called patch sensor 27 made of a reflective type photosensor is disposed so that a detecting part 27*a* (see FIG. 5) is made to face the intermediate transfer belt 16 at a position where the intermediate transfer belt is wound on a backup roller (a pulley) 53 in the side away from the transfer roller 17 and connected to the engine controller 46 of the control unit 40. The CPU 42 of the engine controller 46 outputs light to a transfer surface (the toner image) on the surface of the intermediate transfer belt 16 and evaluates the density (a covering rate by the toner) of the toner image (the toner image on the intermediate transfer belt 16) formed on the photosensitive drum 12 by the development cartridge 14 in accordance with a detecting signal from the patch sensor 27 that photo-electrically converts the reflected light by the toner image on the transfer surface to adjust various conditions.

That is, the CPU 42 of the engine controller 46 detects the density of the toner image formed and transferred on the surface of the intermediate transfer belt 16 on the basis of prepared patch image data by the patch sensor 27 during activation or changing the development cartridge 14. Then, the CPU 42 changes bias voltage supplied between the photosensitive drum 12 and the developing roller 14*a* or between the photosensitive drum 12 and the intermediate transfer belt 16 from a power source 28 in accordance with the detected information of the density of the toner image to adjust the developing density of the electrostatic latent image on the surface of the photosensitive drum 12 or the quality of transfer. Thus, the quality of the image is maintained to a level not lower than a prescribed level. Before the toner image as a patch image in which the detection of the density is finished is transferred and recorded on the recording sheet, residual toner is scraped out and recovered by the cleaner blade 22 of the transfer-side cleaner unit 21. Here, it is to be understood that a position where the power source 28 is arranged is not limited to an illustrated position, and the power source 28 may be arranged at another position or distributed.

Figure 4:
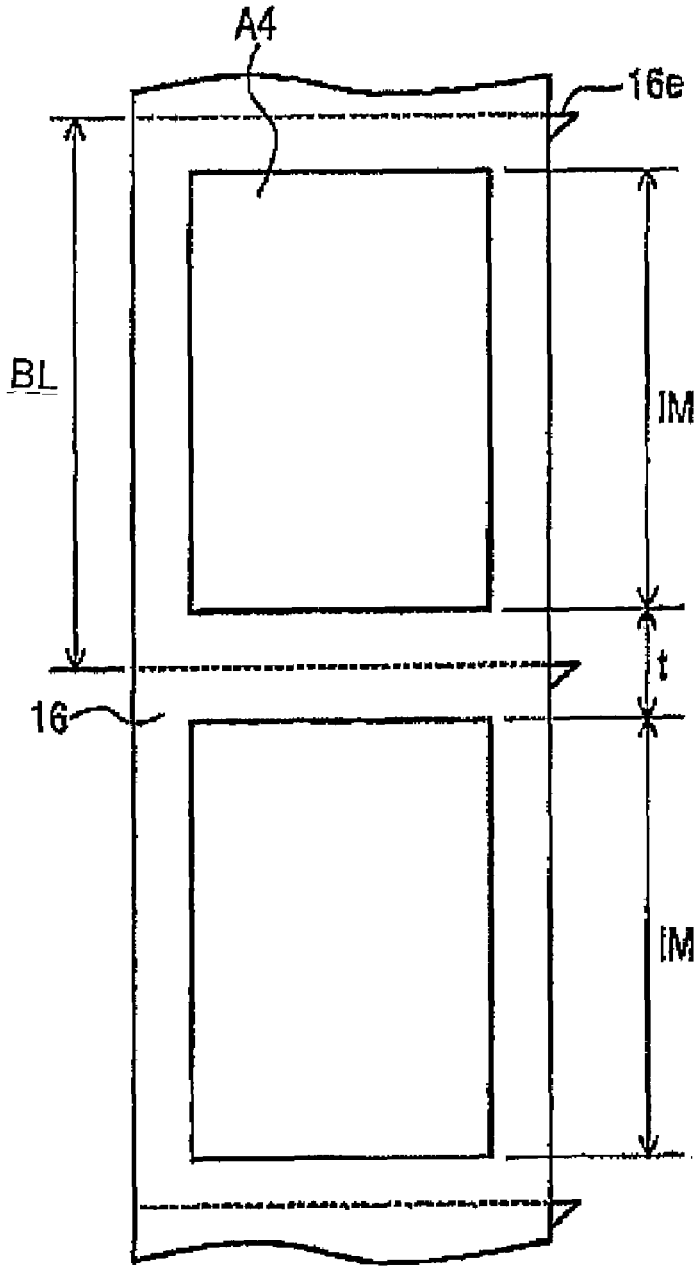
FIG. 4 is a schematic view for explaining an image forming operation performed in the image forming apparatus.

In the image forming apparatus, since the toner image on the surface of the photosensitive drum 12 is transferred to the intermediate transfer belt 16, as shown in FIG. 4, projections 16*e* are projected outward in the planar direction from side edge of the intermediate transfer belt 16. A proximity sensor 29 detects the projection 16*e* for each circulation of the intermediate transfer belt (namely, each cycle BL), so that the CPU 42 of the engine controller 46 controls respectively the image recording apparatus 10 and the sheet conveying apparatus 30 so as to synchronize the rotation of the photosensitive drum 12 or the conveying operation of the recording sheet with the circulation of the intermediate transfer belt 16. While the intermediate transfer belt 16 is circulated, the development rotary unit 15 needs to switch in turn the development cartridges 14 for developing the toner image, especially when the color image is formed. Therefore, in the device in which a single sheet is fed in every sheet feeding operation (it is needless to say that two or more sheets may be fed in every sheet feeding operation), the intermediate transfer belt 16 is set to a length slightly larger than the length of a longer side of the recording sheet of a size, for instance, A4 size. The intermediate transfer belt 16 carries the toner image to be transferred to the recording sheet. On the other hand, the development rotary unit 15 completes the changing operation of the development cartridges 14 while a time period corresponding to a time period a part between the trailing end of the former toner image and the leading end of the latter toner image on the intermediate transfer belt 16 (a part between image forming areas IM) is moved (so-called inter-sheets time period t).

Here, in the development-side cleaner unit 19, the toner image formed by developing the electrostatic latent image on the surface of the photosensitive drum 12 is continuously delivered (primarily transferred) to the intermediate transfer belt 16. Accordingly, it is important to constantly scrape out the toner remaining on the surface of the photosensitive drum 12 by the cleaner blade 19*a* and clean the surface after the toner image is transferred to the intermediate transfer belt 16 in order to accurately form the electrostatic latent image and form the toner image with high quality. Namely, in the development-side cleaner unit 19, the cleaner blade 19*a* is designed to always come into slide contact with the surface of the photosensitive drum 12, scrape out the residual toner and recover the toner to a cleaner housing not shown in the drawing. A flexible sealing member 19*b* comes into slide contact with the surface of the photosensitive drum 12 in the upstream side of the cleaner blade 19*a* to close the recovery space of the cleaner housing so that the scraped residual toner is prevented from floating and leaking outside.

On the other hand, in the transfer-side cleaner unit 21, the toner image on the surface of the intermediate transfer belt 16 that is primarily transferred from the surface of the photosensitive drum 12 is carried on the transfer belt 16 until the toner image is secondarily transferred to the recording sheet. Accordingly, especially when the color image is formed, since the toners of colors of yellow (Y), cyan (C), magenta (M) and black (K) are superposed, the CPU 42 of the engine controller 46 controls and drives the transfer-side cleaner unit 21 to allow the intermediate transfer belt 16 to circulate and operate without scraping out the toner until the toner image on the surface of the intermediate transfer belt 16 is secondarily transferred to the recording sheet.

Figure 5:
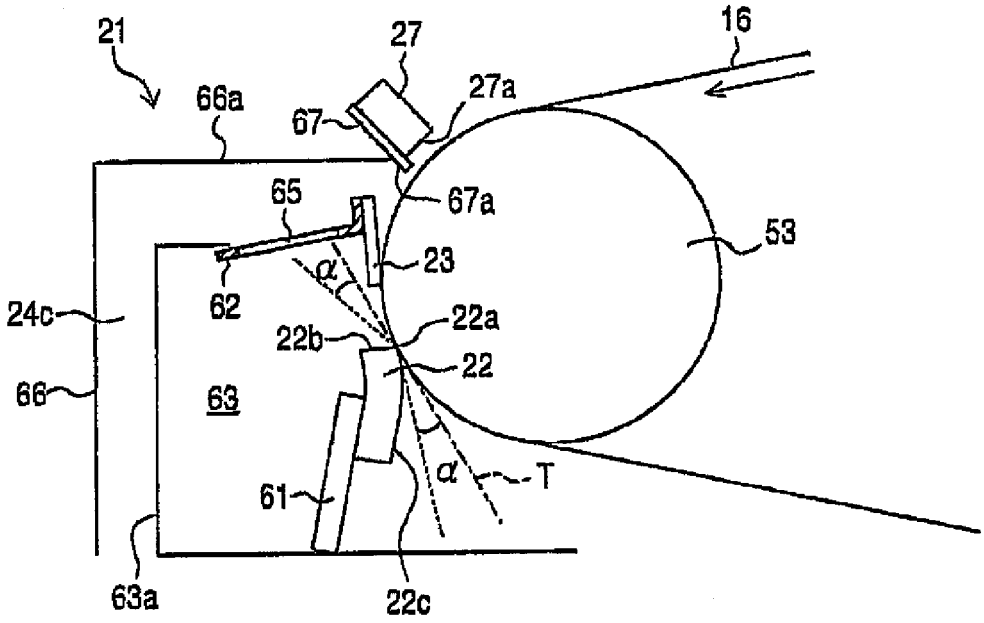
FIG. 5 is a section view of a transfer-side cleaner unit in the image forming apparatus.

That is, the transfer-side cleaner unit 21 is designed in such a way that the cleaner blade 22 is retractable from the surface of the intermediate transfer belt 16 so that the cleaner blade 22 does not scrape out the toner image from the surface of the intermediate transfer belt 16 during a prescribed time period, and the cleaner blade 22 comes into slide contact with the surface of the intermediate transfer belt 16 to scrape out the residual toner and recover the toner to the cleaner housing 63 (see FIG. 5). Similarly, a flexible sealing member 23 is also retractably comes into slide contact with the surface of the intermediate transfer belt 16 in the upstream side of the cleaner blade 22 so that the scraped residual toner does not float and leak outside to close the recovery space of the cleaner housing 63. When the monochromatic image is continuously formed, there may be configured such that the cleaner blade 22 and the sealing member 23 is separated from the surface of the intermediate transfer belt 16, and then, at a timing when the set number of sheets is completely processed, the cleaner blade 22 and the sealing member 23 come in contact with the surface of the intermediate transfer belt 16 to scrape and recover the residual toner.

In the above-described transfer-side cleaner unit 21, when the cleaner blade 22 scrapes out the residual toner from the surface of the intermediate transfer belt 16, the toner temporarily lifts in the cleaner housing 63, what is called a toner cloud is temporarily generated. However, when a certain time period elapses, the floating toner of the toner cloud falls and settles. Thus, even when the cleaner blade 22 and the sealing member 23 are separated from the surface of the intermediate transfer belt 16, the floating toner does not leak out from the cleaner housing 63. However, in a case where a sufficient time period cannot be ensured, as a period during which the toner cloud of the residual toner settles until the cleaner blade 22 and the sealing member 23 abut on the surface of the intermediate transfer belt 16, scrapes out the residual toner and is separated therefrom, due to no room for switching various kinds of operations as an image process is progressively carried out at higher speed, the cleaner blade 22 and the sealing member 23 may be separated from the surface of the intermediate transfer belt 16 before the toner cloud of the floating toner floating due to the slide contact of the cleaner blade 22 with the intermediate transfer belt 16 settles. In addition, the cleaner blade 22 and the sealing member 23 are pivoted toward the cleaner housing 63 to instantaneously generate the rise of pressure and generate an air flow jetted outside. Therefore, there is an anxious that the floating toner leaks outside from the cleaner housing 63. Especially, the toner image is not transferred to the recording sheet and removed and recovered from the surface of the intermediate transfer belt 16 in the transfer-side cleaner unit 21 when a sheet jamming error is occurred or when the toner image is a patch image. Accordingly, at this time, there is an anxious that a large quantity of toner cloud may be generated and a large quantity of floating toner may leak out.

Thus, to the transfer-side cleaner unit 21, a function is added that the floating toner of the toner cloud in the cleaner housing 63 lifting due to the slide contact of the cleaner blade 22 with the surface of the intermediate transfer belt 16 is forcedly reduced to reliably remove and recover the residual toner on the surface of the intermediate transfer belt 16 and prevent the floating toner of the toner cloud from leaking from the cleaner housing 63 even when the cleaner blade 22 and the sealing member 23 are separated from the surface of the intermediate transfer belt 16.

Specifically, as shown in FIG. 5, the transfer cleaner unit 21 comprises: a blade supporting member 61 for supporting the cleaner blade 22 and operating to allow the cleaner blade 22 to retractably come in contact with the surface of the intermediate transfer belt 16; a seal supporting member 62 for supporting the sealing member 23 and operating to allow the sealing member 23 to retractably come in contact with the surface of the intermediate transfer belt 16; and the cleaner housing 63 for defining the recovery space of the residual toner removed from the surface of the intermediate transfer belt 16. These members 61 to 63 are disposed in a further downstream side of the patch sensor 27 in the rotating direction of the intermediate transfer belt 16 and arranged so as to face the intermediate transfer belt 16 wound on the backup roller 53 located in the side separate from the transfer roller 17.

The blade supporting member 61 supports a base end of the cleaner blade 22 such that a tip end thereof can be freely pivoted about a rotary axis not shown in the drawing. Specifically, a corner part 22*a* of the tip end of the cleaner blade 22 can be pivoted to retractably comes in contact with the surface of the intermediate transfer belt 16 wound on the backup roller 53 (lower than a most leftward end surface of the transfer belt 16 in FIG. 5) in such an attitude as to butt against the rotation thereof. Thus, when the cleaner blade 22 scrapes out the residual toner on the surface of the intermediate transfer belt 16, the cleaner blade 22 lifts the toner to generate the toner cloud.

The seal supporting member 62 similarly supports a base end of the sealing member 23 such that a tip end thereof can be freely pivoted about a rotary axis not shown in the drawing, similarly to the blade supporting member 61. Specifically, the tip end of the sealing member 23 can be pivoted in the direction to retractably come in contact with the surface of the intermediate transfer belt 16 wound on the backup roller 53 (lower than a part in the vicinity of the most leftward end surface of the intermediate transfer belt 16 shown in FIG. 5) in such an attitude as to follow the rotation thereof.

The cleaner housing 63 is disposed in a side to which the residual toner scraped from the surface of the intermediate transfer belt 16 by the cleaner blade 22 spills down so as to define the recovery space of the residual toner. For instance, an elastically deformed sponge material is interposed between the blade supporting member 61 for supporting the cleaner blade 22 or the seal supporting member 62 for supporting the sealing member 23 and the cleaner housing 63, so that a gap from which the recovered toner leaks is sealed irrespective of the rotating operations thereof. Namely, the blade supporting member 61 and the seal supporting member 62 form a part of a housing defining member 63*a* for defining the cleaner housing 63. In the lower part of the cleaner housing 63, a conveying screw is arranged for conveying the recovered toner to a tank not shown in the drawing by rotating a screw at a prescribed timing so that the recovery space is not full of the recovered toner and does not spill over.

In the transfer-side cleaner unit 21, on the seal supporting member 62 for supporting the sealing member 23, a vent hole 65 is opened that extends in the width direction of the intermediate transfer belt 16. Further, in the outer peripheral face side of the cleaner housing 63, an outer casing 66 is disposed so as to face the housing defining member 63*a* forming the outer face of the cleaner housing 63 so that an exhaust path 24*c* is formed that communicates with the exhaust duct 24*a* in the upstream side of the filter 25 of the exhausting unit 26. That is, air (gas) in the cleaner housing 63 communicates with the exhaust path 24*c* as a passage of an air flow attracted by the suction fan F to flow via the filter 25 through the vent hole 65.

Here, in the cleaner blade 22, the corner part 22*a* comes into slide contact with the surface of the intermediate transfer belt 16 in such an attitude as to butt against the rotating direction of the surface. As a result, the corner part 22*a* repeats a movement (so-called stick slip) of retracting by a frictional force of the cleaner blade 22 and the intermediate transfer belt 16 while being contracted and coming in contact with the intermediate transfer belt 16 while being extended. The residual toner adhering to the surface of the intermediate transfer belt 16 is scraped out and scattered (float) by the stick slip so that the toner cloud in which the toner floats is generated in the cleaner housing 63. Thus, the toner scraped and scattered by the cleaner blade 22 flies in the direction opposed to a scraping face (tip end face) 22*b*, that is, in a tangential line T on the surface of the intermediate transfer belt 16 at a position with which the corner part 22*a* comes into slide contact. Since the toner mainly flies within a range ranging to a cleaner angle $\alpha$, which is an angle between the surface of the intermediate transfer belt 16 and a side face 22*c* of the corner part 22*a*, from the tangential line T outward (a side away from the surface of the intermediate transfer belt 16), the vent hole 65 of the seal supporting member 62 is designed to be opened in a range including at least the flying direction (a range intersecting the flying direction).

Here, since the sealing member 23 is close to the surface of the intermediate transfer belt 16, the vent hole 65 of the seal supporting member 62 is set to be opened so as to range to the cleaner angle $\alpha$ from the tangential line T outward. However, the present invention is not limited thereto and the vent hole may be set to be opened depending on its structure. For instance, the vent hole may be opened so as to range to the cleaner angle $\alpha$ from the tangential line T inward. Further, it is to be understood that when the vent hole can be opened so as to have the cleaner angle $\alpha$ straddling the tangential line T, the flying direction of the toner can be the more preferably reliably covered.

Thus, in the transfer-side cleaner unit 21, the vent hole 65 is opened in the flying direction of the toner of the toner cloud floating due to the slide contact of the cleaner blade 22 with the surface of the intermediate transfer belt 16 to allow the toner to pass without preventing the toner from advancing. The toner enters the exhaust path 24*c* of the exhausting unit 26 through the vent hole 65 and is attracted to the filter 25 and caught. As a result, a quantity of the toner cloud (floating toner) floating and retained in the cleaner housing 63 can be reduced. Even when the cleaner blade 22 and the sealing member 23 are separated from the surface of the intermediate transfer belt 16, a large quantity of the floating toner of the toner cloud can be prevented from leaking out. In this embodiment, the filter 25 of the exhausting unit 26 is designed to catch the toner is described. However, the present invention is not limited thereto, and the filter 25 may be arranged in the vent hole 65 to directly catch the flying toner.

Further, since the vent hole 65 is opened and formed in the seal supporting member 62, even when the seal supporting member 62 is pivoted so as to reduce volume in the cleaner housing 63 in order to separate the sealing member 23 from the surface of the intermediate transfer belt 16, air in the cleaner housing 63 can be effectively allowed to pass (vent) so that an instantaneous and large pressure variation can be prevented from arising. Further, the air or the toner cloud (floating toner) in the cleaner housing 63 can be prevented from being jetted from a gap formed by the sealing member 23 separating from the surface of the intermediate transfer belt 16 in accordance with the rise of pressure due to the pressure variation.

Further, the vent hole 65 is opened so as to allow air freely pass to the exhaust path 24*c* communicating with the exhaust duct 24*a* of the exhausting unit 26, the pressure in the cleaner housing 63 can be made to be liable to be a negative pressure. Even when the seal supporting member 62 is pivoted so as to reduce the volume in the cleaner housing 63 in order to separate the sealing member 23 from the surface of the intermediate transfer belt 16, the pressure in the cleaner housing 63 can be prevented from being instantaneously extremely higher than that of an outer part. Further, the air or the toner cloud (floating toner) in the cleaner housing 63 can be prevented from being jetted from the gap formed by the sealing member 23 separating from the surface of the intermediate transfer belt 16 in accordance with the rise of the pressure.

Further, in the transfer-side cleaner unit 21, a top face 66*a* of an outer casing 66 for defining the exhaust path 24*c* communicating with the exhaust duct 24*a* of the exhausting unit 26 is connected to a sensor supporting member 67 for supporting the patch sensor 27. The sensor supporting member 67 has an end 67*a* which is located closely to the intermediate transfer belt 16 while extending in a width direction of the intermediate transfer belt 16, so that the sensor supporting member 67 serves as a shield plate.

Here, in the vicinity of the surface of the intermediate transfer belt 16, an air flow is generated that is dragged by the circulation of the intermediate transfer belt 16. This air flow moves round from a gap between the surface of the intermediate transfer belt 16 and the end 67*a* of the sensor supporting member 67 of the patch sensor 27. Further, a path on the surface of the intermediate transfer belt 16 between the patch sensor 27 and the vent hole 65 communicates with the exhaust path 24*c* and narrowed by the end 67*a* of the sensor supporting member 67.

Thus, even when the toner entering the exhaust path 24*c* from the vent hole 65 approaches the detecting part 27*a* side of the patch sensor 27, since the air flow dragged by the surface of the intermediate transfer belt 16 enters the gap between the end 67*a* of the sensor supporting member 67 and the surface of the intermediate transfer belt 16, the toner is returned to the exhaust path 24*c* side or sticks to the surface of the intermediate transfer belt 16 and is scraped out by the cleaner blade 22 in the cleaner housing 63.

Therefore, the toner cloud in the cleaner housing 63 can be effectively collected. Even when the cleaner blade 22 and the sealing member 23 are separated from the surface of the intermediate transfer belt 16, the floating toner of the toner cloud can be restrained from leaking outside the cleaner housing 63. The floating toner can be prevented from reaching the detecting part 27*a* of the patch sensor 27. The detecting part 27*a* can be prevented from being stuck by or contaminated with the toner.

Further, the toner can be prevented from adhering and remaining in the image forming area of the intermediate transfer belt 16 to mix colors and deteriorate the quality of the image or the floating toner can be prevented from adhering to the periphery of the transfer-side cleaner unit 21 which makes a maintenance work difficult.

Next, a second embodiment of the present invention will be described. Here, components similar to those in the above-described embodiment are designated by the same reference numerals and repetitive explanations will be omitted.

Figure 6:
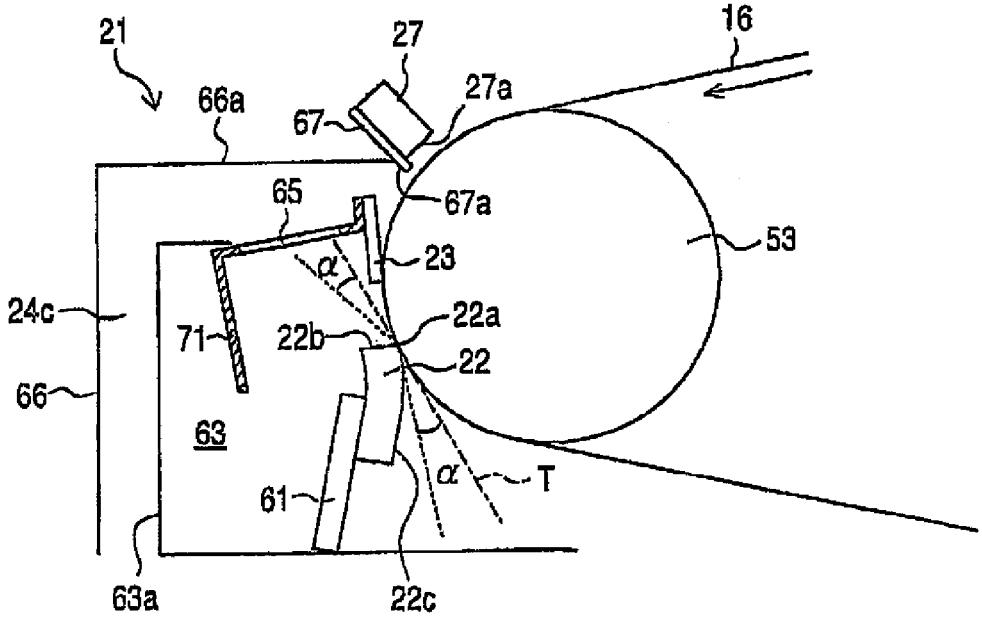
FIG. 6 is a section view of a transfer-side cleaner unit according to a second embodiment of the invention.

As shown in FIG. 6, in this embodiment, a rectifying plate 71 is connected to a seal supporting member 62. The rectifying plate 71 is extended to the inner part of a cleaner housing 63 from an opposite side end part to a sealing member 23 to reach substantially the height of a scraping face 22*b* of a cleaner blade 22.

Thus, in a transfer-side cleaner unit 21, the rectifying plate 71 adjacent to a vent hole 65 in the cleaner housing 63 can guide toner scraped and floating from the surface of an intermediate transfer belt 16 by the cleaner blade 22 to the vent hole 65. Even when the flying direction of the toner scraped and floating from the surface of the intermediate transfer belt 16 deviates from a position where the vent hole 65 is formed, the toner can be guided to the vent hole 65 to allow the toner to enter an exhaust path 24*c* of an exhausting unit 26.

Next, a third embodiment of the present invention will be described. Here, components similar to those in the above-described embodiments are designated by the same reference numerals and repetitive explanations will be omitted.

Figure 7:
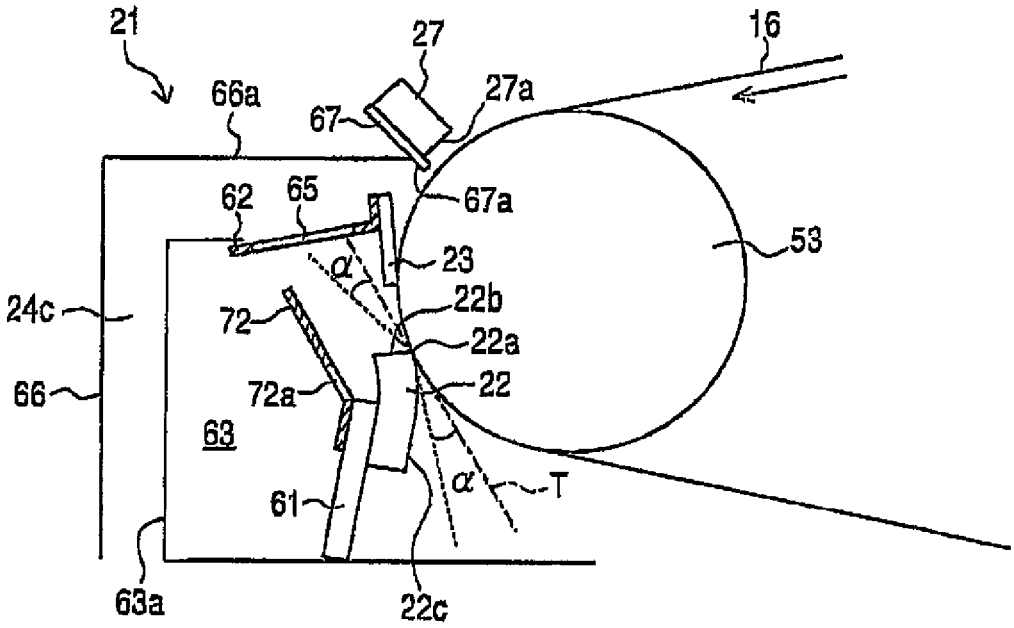
FIG. 7 is a section view of a transfer-side cleaner unit according to a third embodiment of the invention.

As shown in FIG. 7, in this embodiment, a rectifying plate 72 is disposed on a blade supporting member 61. The rectifying plate 72 is formed so as to protrude beyond a scraping face 22*b* in the back face side of a cleaner blade 22 and extend to a part near the edge of the vent hole 65 of a seal supporting member 62 opposite to a sealing member 23.

Thus, in a transfer-side cleaner unit 21, the rectifying plate 72 adjacent to the cleaner blade 22 and extending to the part near the edge of the vent hole 65 can guide toner scraped and floating from the surface of an intermediate transfer belt 16 by the cleaner blade 22 to the vent hole 65. Even when the flying direction of the toner scraped and floating from the surface of the intermediate transfer belt 16 deviates from a position where the vent hole 65 is formed, the toner can be guided to the vent hole 65 to allow the toner to enter an exhaust path 24*c* of an exhausting unit 26.

Since the rectifying plate 72 defines a space that can accommodate the toner between the cleaner blade 22 and the rectifying plate 72, an opening 72*a* is formed through which a bottom part communicates with a toner recovery space in a cleaner housing 63.

Next, a fourth embodiment of the present invention will be described. Here, components similar to those in the above-described embodiments are designated by the same reference numerals and repetitive explanations will be omitted.

Figure 8:
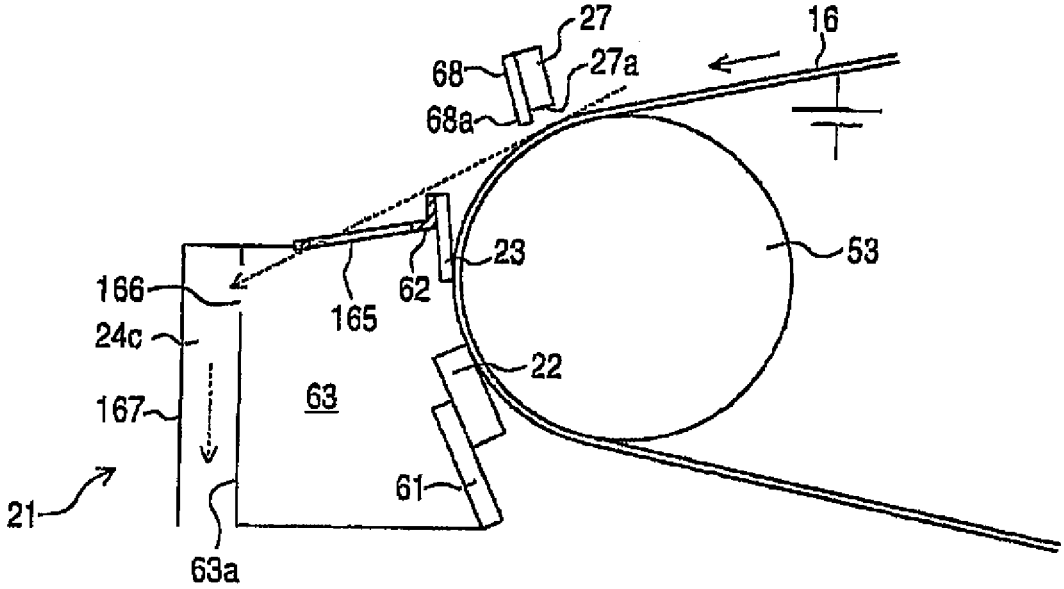
FIG. 8 is a section view of a transfer-side cleaner unit according to a fourth embodiment of the invention.

As shown in FIG. 8, in this embodiment, a cleaner blade 22, a sealing member 23 and a blade supporting member 61 form a part of a housing defining member 63*a* for defining the outer face of a cleaner housing 63. A seal supporting member 62 for supporting the sealing member 23 has an intake port 165 opened so as to extend in the width direction of an intermediate transfer belt 16. Further, in the upper part of the housing defining member 63*a* located in a side wall of a back face side of the sealing member 23, an exhaust port 166 is opened that similarly extends in the width direction of the intermediate transfer belt 16. Further, for the housing defining member 63*a* to which the exhaust port 166 is opened, an outer casing 167 is disposed so as to face the housing defining member 63, so that an exhaust path 24*c* is formed that communicates with an exhaust duct 24*a* in the upstream side of a filter 25 of an exhausting unit 26. The cleaner housing 63 communicates, through the exhaust port 166, with the exhaust path 24*c* of a passage of an air flow in which air (gas) is drawn to flow by a suction fan F through the filter 25.

Namely, the intake port 165 is opened in the seal supporting member 62 arranged in the vicinity of an inlet to the cleaner housing 63 in the rotating direction of the surface of the intermediate transfer belt 16. The exhaust port 166 is located on a tangential line on the surface of the intermediate transfer belt 16 passing through the intake port 165.

Here, in the vicinity of the surface of the intermediate transfer belt 16, an air flow is generated that is dragged by the circulation of the intermediate transfer belt 16. This air flow moves round from a gap between the surface of the intermediate transfer belt 16 and an end 68*a* of a sensor supporting member 68 of a patch sensor 27, enters the cleaner housing 63 together with a residual toner on the surface so as to push down the sealing member 23 or flows on upper side of the seal supporting member 62. The end 68*a* is located closely to the intermediate transfer belt 16 while extending in a width direction of the intermediate transfer belt 16, so that the sensor supporting member 68 serves as a shield plate. Thus, a path on the surface of the intermediate transfer belt 16 between the patch sensor 27 and the intake port 165 is narrowed and restricted so that the air flow dragged by the surface of the intermediate transfer belt 16 and entering the intake port 165 side is stabilized to a prescribed quantity.

Thus, the air flow dragged by the surface of the of the intermediate transfer belt 16 to enter the gap between the end 68*a* of the sensor supporting member 68 and the surface of the intermediate transfer belt 16 becomes a stabilized air flow. The air flow substantially flows on the upper face of the seal supporting member 62 to enter the cleaner housing 63 from the intake port 165 adjacent to the surface of the intermediate transfer belt 16, and then, moves in an advancing direction without a stress. Thus, the air flow is ejected to the exhaust path 24*c* from the exhaust port 166 in the housing defining member 63*a* without raising an internal pressure in the cleaner housing 63 and drawn by the suction fan F through the filter 25 of the exhausting unit 26.

Further, the air flow, dragged by the surface of the intermediate transfer belt 16 and entering the cleaner housing 63 by way of the slide contact position of the surface of the intermediate transfer belt with the sealing member 23 and the gap between the end 68*a* of the sensor supporting member 68 and the surface of the intermediate transfer belt 16, acts to raise the internal pressure in the cleaner housing 63. However, in this embodiment, since the air flow flows to the exhaust port 166 from the intake port 165 side, the air flow is ejected from the exhaust port 166, so that the internal pressure is not raised.

Accordingly, even when the seal supporting member 62 is pivoted so as to reduce volume in the cleaner housing 63 in order to separate the sealing member 23 from the surface of the intermediate transfer belt 16, the pressure in the cleaner housing can be prevented from considerably varied. Further, air or a toner cloud (floating toner) in the cleaner housing 63 can be prevented from being jetted from the gap where the sealing member 23 is separated from the surface of the intermediate transfer belt 16 in accordance with the rise of pressure due to the pressure variation.

Since the intake port 165 is opened to allow the air to freely enter and flow out, the floating toner of the toner cloud in the cleaner housing 63 can be also ejected in view of its structure (since the air enters from the intake port 165, the floating toner is actually hardly ejected). However, even when the floating toner moves to a detecting part 27*a* side of the patch sensor 27, since the air flow dragged by the surface of the intermediate transfer belt 16 enters the gap between the end 68*a* of the sensor supporting member 68 and the surface of the intermediate transfer belt 16, the toner is returned to the intake port 165 side or sticks to the surface of the intermediate transfer belt 16 and is scraped out by the cleaner blade 22 in the cleaner housing 63.

Thus, in a transfer-side cleaner unit 21, since the path of the air flow flowing to the exhaust port 166 from the intake port 165 exists in the flying direction of the toner of the toner cloud floating due to the slide contact of the cleaner blade 22 with the surface of the intermediate transfer belt 16, the toner can be carried on the air flow and ejected from the exhaust port 166. The toner is attracted to the filter 25 and caught through the exhaust path 24*c* of the exhausting unit 26. As a result, a quantity of the toner cloud (floating toner) floating and retained in the cleaner housing 63 can be reduced. Even when the cleaner blade 22 and the sealing member 23 are separated from the surface of the intermediate transfer belt 16, a large quantity of the floating toner of the toner cloud can be prevented from leaking out. Here, a case that the filter 25 of the exhausting unit 26 is designed to catch the toner is described, however, the present invention is not limited thereto, and the filter may be arranged in the exhaust port 166 to directly catch the flying toner.

Further, since the intake port 165 is opened in the seal supporting member 62, even when the seal supporting member 62 is pivoted so as to reduce volume in the cleaner housing 63 in order to separate the sealing member 23 from the surface of the intermediate transfer belt 16, air in the cleaner housing 63 can be effectively allowed to pass (vent) so that a large pressure variation can be prevented from instantaneously arising. Further, the air or the toner cloud (floating toner) in the cleaner housing 63 can be prevented from being jetted from a gap formed when the sealing member 23 is separated from the surface of the intermediate transfer belt 16 in accordance with the rise of pressure due to the pressure variation.

Further, since the exhaust port 166 is opened so as to allow air freely pass to the exhaust path 24*c* communicating with the exhaust duct 24*a* of the exhausting unit 26, the pressure in the cleaner housing 63 can be made to be apt to be a negative pressure. Even when the seal supporting member 62 is pivoted so as to reduce the volume in the cleaner housing 63 in order to separate the sealing member 23 from the surface of the intermediate transfer belt 16, the pressure in the cleaner housing 63 can be prevented from being instantaneously extremely higher than that of an outer part. Further, the air or the toner cloud (floating toner) in the cleaner housing 63 can be prevented from being jetted from the gap formed by the sealing member 23 separating from the surface of the intermediate transfer belt 16 in accordance with the rise of the pressure.

Therefore, the toner cloud in the cleaner housing 63 can be effectively collected. Even when the cleaner blade 22 and the sealing member 23 are separated from the surface of the intermediate transfer belt 16, the floating toner of the toner cloud can be restrained from leaking outside the cleaner housing 63. The floating toner of the toner cloud can be prevented from reaching the patch sensor 27 or the surface of the intermediate transfer belt 16. The detecting part 27*a* thereof can be prevented from being stuck by or contaminated with the toner.

Further, the toner can be prevented from adhering and remaining in the image forming area of the intermediate transfer belt 16 to mix colors and deteriorate the quality of an image or the floating toner can be prevented from adhering to the periphery of the transfer-side cleaner unit 21 which makes a maintenance work difficult.

Next, a fifth embodiment of the present invention will be described. Here, components similar to those in the above-described embodiments are designated by the same reference numerals and repetitive explanations will be omitted.

Figure 9:
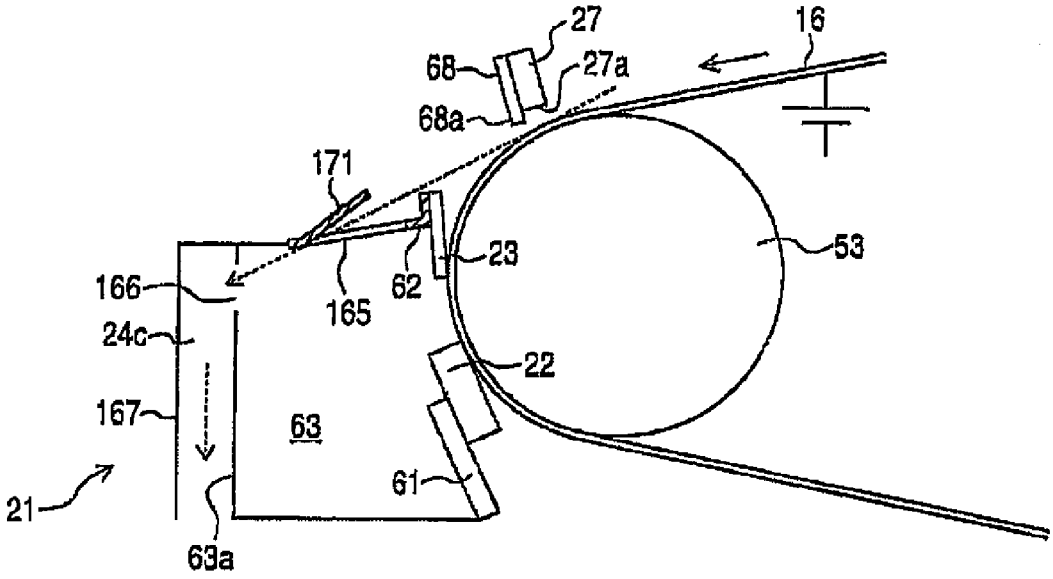
FIG. 9 is a section view of a transfer-side cleaner unit according to a fifth embodiment of the invention.

As shown in FIG. 9, in this embodiment, an introduction plate 171 is connected to a seal supporting member 62 so as to extend substantially parallel to a tangential line connecting the surface of an intermediate transfer belt 16 and an edge of an intake port 165 being away from a sealing member 23 (in other words, substantially parallel to a direction connecting the intake port 165 and an exhaust port 166) to take in an air flow dragged on the surface of the intermediate transfer belt to a cleaner housing 63 from the intake port 165, rectify and guide the air flow to the exhaust port 166.

Thus, in a transfer cleaner unit 21, most of the air flow dragged on the surface of the intermediate transfer belt 16 and flowing on the upper face side of the seal supporting member 62 through a gap between an end 68*a* of a sensor supporting member 68 of a patch sensor 27 and the surface of the intermediate transfer belt 16 can be guided to the intake port 165. The air flow flowing to the exhaust port 166 from the intake port 165 can be further stabilized. Therefore, internal pressure in a cleaner housing 63 is stabilized to prevent a pressure variation from being generated with a higher reliability and toner scraped and flowing from the surface of the intermediate transfer belt 16 can be carried by the air flow to be exhausted from the exhaust port 166 and caught by a filter 25.

Next, a sixth embodiment of the present invention will be described. Here, components similar to those in the above-described embodiments are designated by the same reference numerals and repetitive explanations will be omitted.

Figure 10:
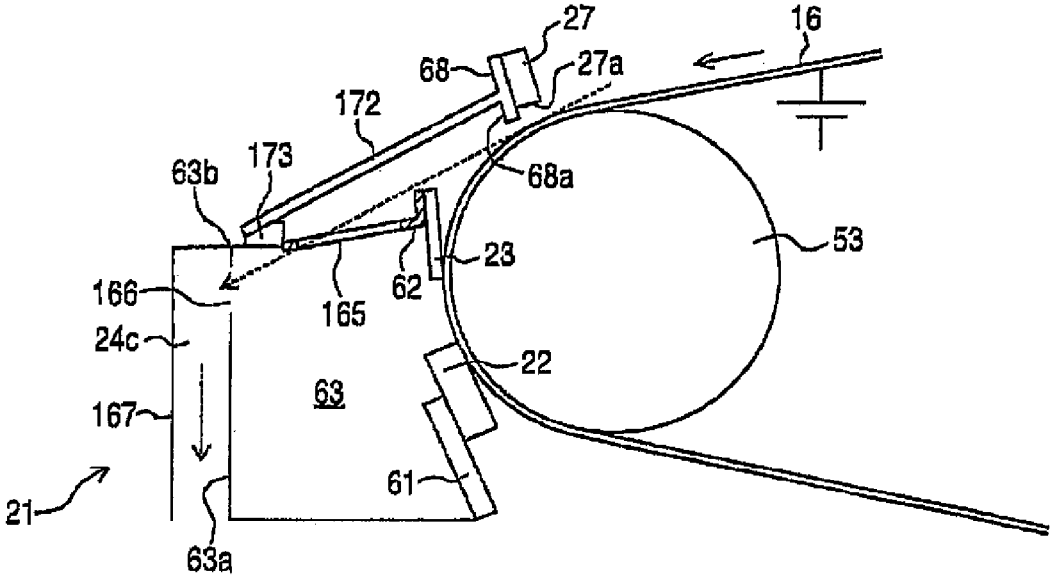
FIG. 10 is a section view of a transfer-side cleaner unit according to a sixth embodiment of the invention.

As shown in FIG. 10, in this embodiment, a rectifying plate 172 is connected to a sensor supporting member 68 of a patch sensor 27 so as to extend parallel to a tangential line connecting the surface of an intermediate transfer belt 16 and a corner part 63*b* of a housing defining member 63*a* being away from the surface of the intermediate transfer belt 16 than a seal supporting member 62 (in other words, parallel to a direction connecting an intake port 165 and an exhaust port 166), thereby extending along the surface of the intermediate transfer belt 16. In a part between the rectifying plate 172 and the corner part 63*b* of the housing defining member 63*a*, for instance a sponge material 173 is provided so as to bury a gap to prevent most of an air flow taken in between them and flowing on the upper face of the sealing member 62 from leaking.

Thus, in a transfer-side cleaner unit 21, the air flow dragged on the surface of the intermediate transfer belt 16 and flowing on the upper face of the seal supporting member 62 through a gap between an end 68*a* of the sensor supporting member 68 and the surface of the intermediate transfer belt 16 can be substantially guided to the intake port 165. The air flow flowing to the exhaust port 166 from the intake port 165 can be further stabilized. Therefore, internal pressure in a cleaner housing 63 can be stabilized to prevent a pressure variation from being generated therein with a higher reliability and toner scraped and flowing from the surface of the intermediate transfer belt 16 can be carried by the air flow to be exhausted from the exhaust port 166 and caught by a filter 25.

Further, since the rectifying plate 172 is connected to the sensor supporting member 68 to be supported, the rectifying plate 172 can be attached as a part of the sensor supporting member 68. Thus, the rectifying plate can be more inexpensively installed than a case that the rectifying plate is separately designed and attached.

Next, a seventh embodiment of the present invention will be described. Here, components similar to those in the above-described embodiments are designated by the same reference numerals and repetitive explanations will be omitted.

Figure 11:
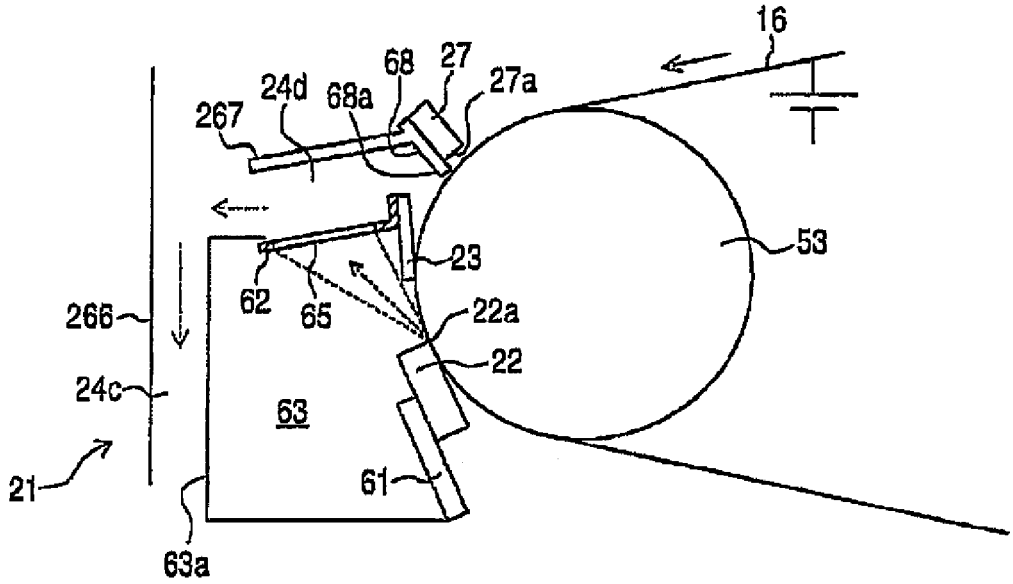
FIG. 11 is a section view of a transfer-side cleaner unit according to a seventh embodiment of the invention.

As shown in FIG. 11, in this embodiment, in a seal supporting member 62 for supporting a sealing member 23 and defining a cleaner housing 63, a vent hole 65 is opened so as to extend in the width direction an intermediate transfer belt 16. Further, in the outside of the cleaner housing 63, an outer casing 266 is disposed so as to face a housing defining member 63*a* forming the outer face of the cleaner housing 63 so that an exhaust path 24*c* is formed communicating with an exhaust duct 24*a* in an upstream side of a filter 25 of an exhausting unit 26. An outer casing (a rectifying plate) 267 is disposed so as to face the seal supporting member 62 so that an exhaust path 24*d* is formed for rectifying an air flow dragged by the surface of the intermediate transfer belt 16 to supply the air flow to the exhaust path 24*c*. That is, the cleaner housing 63 communicates, through the vent hole 65, with the exhaust paths 24*c* and 24*d* as passages of the air flow in which air (gas) attracted by a suction fan F to flow through the filter 25.

Thus, in a transfer-side cleaner unit 21, the vent hole 65 is opened in the flying direction of the toner of a toner cloud floating due to the slide contact of a cleaner blade 22 with the surface of the intermediate transfer belt 16 to allow the toner to pass without preventing the toner from advancing. The toner enters the exhaust paths 24*c* and 24*d* of the exhausting unit 26 through the vent hole 65 and is attracted to the filter 25 and caught. That is, the filter 25 serves to restrict the movement of the floating toner. As a result, a quantity of the toner cloud (floating toner) floating and staying in the cleaner housing 63 can be reduced. Even when the cleaner blade 22 and the sealing member 23 are separated from the surface of the intermediate transfer belt 16, a large quantity of the floating toner of the toner cloud can be prevented from leaking out.

Further, in the transfer-side cleaner unit 21, the outer casing 267 is provided for defining the exhaust path 24*d* of the exhausting unit 26 is connected to a sensor supporting member 68 for supporting a patch sensor 27. The sensor supporting member 68 has an end 68*a* extending in the width direction of the intermediate transfer belt 16 and disposed closely to the surface of the intermediate transfer belt 16 to serve as a shield plate.

Here, in the vicinity of the surface of the intermediate transfer belt 16, the air flow is generated that is dragged and rotated by the rotating operation of the surface thereof. This air flow moves round from a gap between the surface of the intermediate transfer belt 16 and the end 68*a* of the sensor supporting member 68 of the patch sensor 27. Further, a path on the surface of the intermediate transfer belt 16 between the patch sensor 27 and the vent hole 65 communicates with the exhaust path 24*d* and is narrowed by the end 68*a* of the sensor supporting member 68.

Thus, even when the toner entering the exhaust path 24*d* from the vent hole 65 moves to a detecting part 27*a* side of the patch sensor 27, since the air flow dragged by the surface of the intermediate transfer belt 16 enters the gap between the end 68*a* of the sensor supporting member 68 and the surface of the intermediate transfer belt 16, the toner is returned to the exhaust path 24*d* side or sticks to the surface of the intermediate transfer belt 16 and is scraped out by the cleaner blade 22 in the cleaner housing 63.

Therefore, the toner cloud in the cleaner housing 63 can be effectively collected. Even when the cleaner blade 22 and the sealing member 23 are separated from the surface of the intermediate transfer belt 16, the floating toner of the toner cloud can be restrained from leaking outside the cleaner housing 63. The floating toner can be prevented from reaching the detecting part 27*a* of the patch sensor 27. The detecting part 27*a* can be prevented from being stuck by or contaminated with the toner.

Further, the toner can be prevented from adhering and remaining in the image forming area of the intermediate transfer belt 16 to mix colors and deteriorate the quality of an image or the floating toner can be prevented from adhering to the periphery of the transfer-side cleaner unit 21 which makes a maintenance work difficult.

Next, an eighth embodiment of the present invention will be described. Here, components similar to those in the above-described embodiments are designated by the same reference numerals and repetitive explanations will be omitted.

Figure 12:
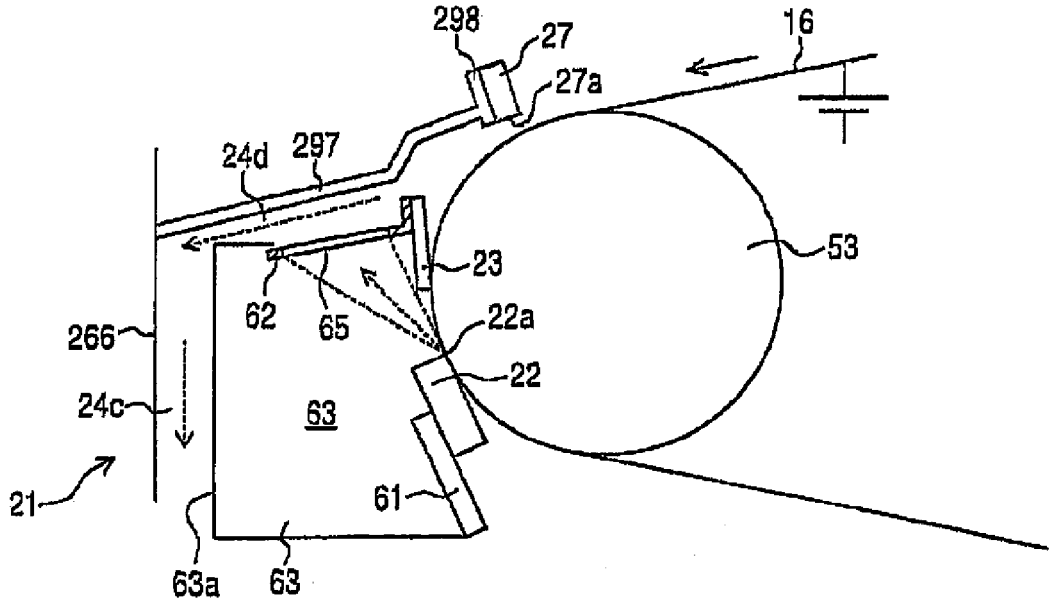
FIG. 12 is a section view of a transfer-side cleaner unit according to an eighth embodiment of the invention.

As shown in FIG. 12, in this embodiment, an outer casing 297 for defining an exhaust path 24*d* of an exhausting unit 26 is connected to a sensor supporting member 298 for supporting a patch sensor 27. A side of the outer casing 297 being away from the patch sensor 27 is bent so as to come closely to a seal supporting member 62 to restrict a passage of an air flow of the exhaust path 24*d*. A rear end of the outer casing 297 is connected to an outer casing 266 not to open a part between the exhaust paths 24*c* and 24*d* of the exhausting unit 26 to an external part.

Further, the sensor supporting member 298 to which the outer casing 297 is connected is designed so that air dragged by the surface of an intermediate transfer belt 16 is not shielded to be introduced to a part between the detecting part 27*a* of the patch sensor 27 and the surface of the intermediate transfer belt 16 and to the exhaust path 24*d*.

Thus, an inner part of the exhaust path 24*d* on the upper face side of the seal supporting member 62 is more strongly attracted by a suction fan F of the exhausting unit 26, and the air dragged by the surface of the intermediate transfer belt 16 is directly introduced to the exhaust path 24 side, and then, the air increases its moving speed due to the restricted form by the outer casing 297 to pass the upper face side of the seal supporting member 62. Thus, air in a cleaner housing 63 can be more strongly drawn and vented to an exhaust path 24*c* side through a vent hole 65. Toner scraped out and floating due to the slide contact of a cleaner blade 22 with the surface of the intermediate transfer belt 16 and passing through the vent hole 65 can be more effectively sucked.

Next, a ninth embodiment of the present invention will be described. Here, components similar to those in the above-described embodiments are designated by the same reference numerals and repetitive explanations will be omitted.

Figure 13:
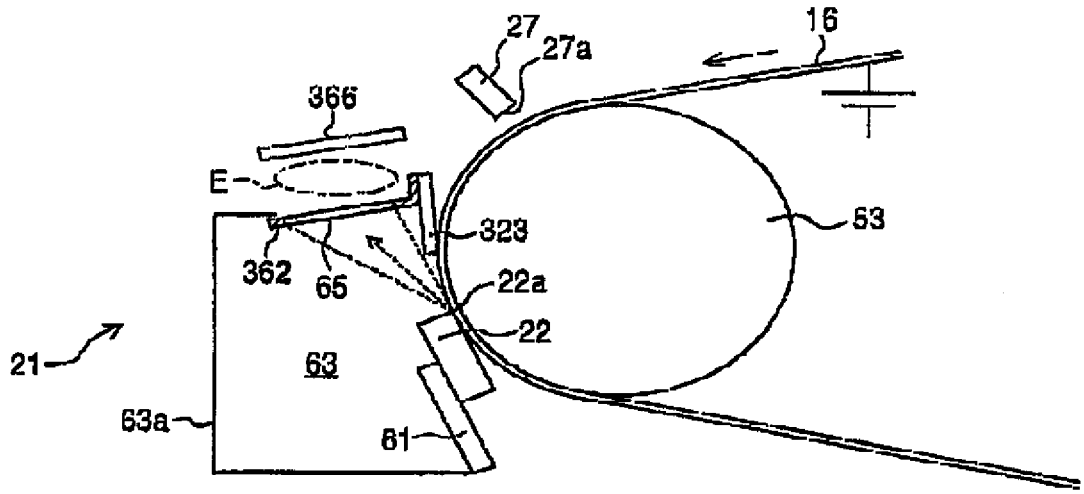
FIG. 13 is a section view of a transfer-side cleaner unit according to a ninth embodiment of the invention.

As shown in FIG. 13, in this embodiment, a seal supporting member 362 for supporting a sealing member 323 and defining a cleaner housing 63 is formed with a conductive material such as a metal plate. The sealing member 323 is formed as a film by molding a conductive polyethylene material. Thus, when the seal supporting member 362 pivots together with a cleaner blade 22 of a blade supporting member 61 to allow the sealing member 323 to abut on the surface of an intermediate transfer belt 16, the sealing member 323 comes into sliding and conductive contact with all the periphery of the electrode part 16*d* of the intermediate transfer belt 16, so that a positive potential the same as that of the intermediate transfer belt 16 is applied thereto to have substantially the same potential as that of the intermediate transfer belt 16.

Therefore, in the seal supporting member 362, a vent hole 65 extending in the width direction of the intermediate transfer belt 16 is set to be opened within a range including at least the flying direction of toner (a range intersecting the flying direction). At a position facing and opposed to the vent hole 65 outside the cleaner housing 63, an opposing member 366 made of a conductive material, for instance, a metal plate is disposed. To the opposing member 366, a positive voltage higher than a positive voltage supplied to the intermediate transfer belt 16 is adapted to be applied from a power source 28 during a time period when a CPU 42 of an engine controller 46 controls the sealing member 323 to come into slide contact with the surface of the intermediate transfer belt 16, in other words, during a time period for maintaining the rotating operation of the seal supporting member 362.

Accordingly, since a potential difference is applied between the seal supporting member 362 and the opposing member 366, an electric field E in which the floating toner of a negative potential is attracted and absorbed to the opposing member 366 side can be generated. The floating toner of a toner cloud floating due to the slide contact of the cleaner blade 22 with the surface of the intermediate transfer belt 16 can be attracted and adsorbed to the opposing member 366 side through the vent hole 65 to forcedly settle the toner. That is, the seal supporting member 362 and the opposing member 366 serve an electric field generator to restrict the movement of the floating toner.

When the sealing member 323 is separated from the surface of the intermediate transfer belt 16 (the supply of voltage to the seal supporting member 362 is shut off), since the application of voltage to the opposing member 366 from the power source 28 is simultaneously shut off, the toner adsorbed to the opposing member 366 drops in cleaner housing 63 and is recovered.

Thus, in a transfer-side cleaner unit 21, the vent hole 65 is opened in the flying direction of the toner of the toner cloud floating due to the slide contact of the cleaner blade 22 with the surface of the intermediate transfer belt 16 to allow the toner to pass without preventing the toner from advancing. The floating toner can be attracted and adsorbed to the opposing member 366 through the vent hole 65 and recovered. As a result, a quantity of the toner cloud (floating toner) floating and retained in the cleaner housing 63 can be reduced. Even when the cleaner blade 22 or the sealing member 323 is separated from the surface of the intermediate transfer belt 16, a large quantity of the floating toner of the toner cloud can be prevented from leaking outside the cleaner housing 63.

Therefore, the toner cloud in the cleaner housing 63 can be effectively collected. Even when the cleaner blade 22 or the sealing member 323 is separated from the surface of the intermediate transfer belt 16, the floating toner of the toner cloud can be restrained from leaking outside the cleaner housing 63.

Accordingly, parts of peripheral devices are not stuck by or contaminated with the toner. For instance, the toner can be prevented from sticking to a detecting part 27*a* of a patch sensor 27 so that the precise density of the toner cannot be detected, or the toner can be prevented from adhering and remaining in the image forming area of the intermediate transfer belt 16 to mix colors and deteriorate the quality of an image or the floating toner can be prevented from adhering to the periphery of the transfer-side cleaner unit 21 which makes a maintenance work difficult.

In this embodiment, the positive voltage higher than that of the intermediate transfer belt 16 is supplied to the opposing member 366, so that the electric field E for attracting and adsorbing the toner of the negative potential is adapted to be generated. However, the opposing member 366 may be connected to an earth to have a zero potential, or a voltage may be supplied to generate a reverse electric field. In this case, an electric field can be generated in which the toner of the negative potential scraped and scattered by the cleaner blade 22 is restrained from moving not to pass the vent hole 65 but to attract and adsorb the toner to the seal supporting member 362 side. As soon as the sealing member 323 is separated from the surface of the intermediate transfer belt 16 (the supply of the voltage to the seal supporting member 362 is shut off), the toner adsorbed to the seal supporting member 362 is dropped in the cleaner housing 63 and recovered.

Further, a structure may be designed in which the opposing member 366 is not provided and the vent hole 65 is not opened in the seal supporting member 362. In this case, the toner scraped and scattered by the cleaner blade 22 can be adsorbed to the lower face of the seal supporting member like the surface of the intermediate transfer belt 16. When the sealing member 323 is separated from the surface of the intermediate transfer belt 16 (the supply of the voltage to the seal supporting member 362 is shut off), the toner adsorbed to the lower face of the seal supporting member is simultaneously dropped in the cleaner housing 63 and recovered.

Next, a tenth embodiment of the present invention will be described. Here, components similar to those in the above-described embodiments are designated by the same reference numerals and repetitive explanations will be omitted.

Figure 14:
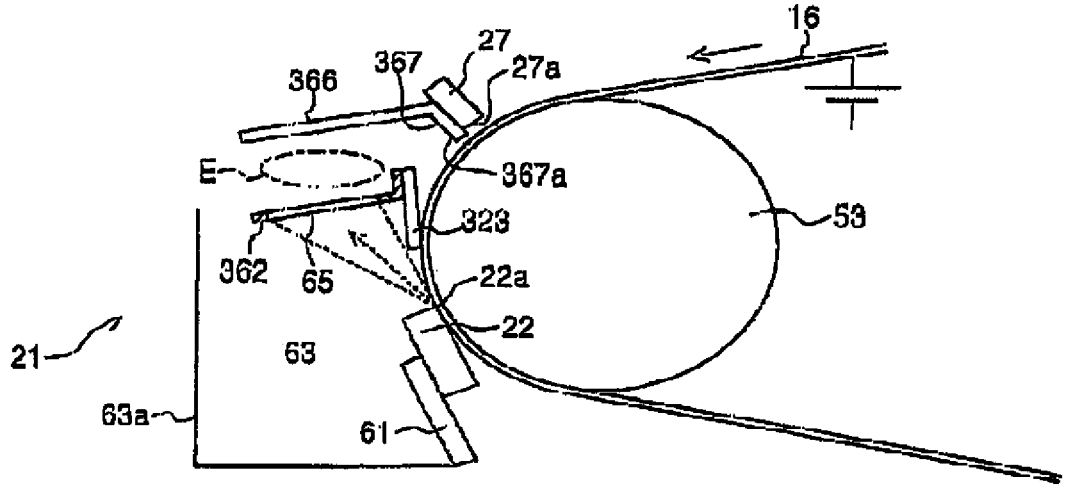
FIG. 14 is a section view of a transfer-side cleaner unit according to a tenth embodiment of the invention.

As shown in FIG. 14, in this embodiment, an opposing member 366 facing a seal supporting member 362 is connected to a sensor supporting member 367 for supporting a patch sensor 27. The sensor supporting member 367 has an end 367*a* extending in the width direction of an intermediate transfer belt 16 and disposed closely to the surface of the intermediate transfer belt 16 to serve as a shield plate.

Thus, an air flow is generated that air is dragged by the circulation of the surface the intermediate transfer belt 16. This air flow moves round from a gap between the end 367*a* of the sensor supporting member 367 and the surface of the intermediate transfer belt 16. Further, a path on the surface of the intermediate transfer belt 16 between a vent hole 65 of the seal supporting member 362 and the patch sensor 27 is narrowed by the end 367*a* of the sensor supporting member 367.

Accordingly, even when toner ejected to the opposing member 366 side from the vent hole 65 moves to a detecting part 27*a* of the patch sensor 27, since the air flow dragged by the surface of the intermediate transfer belt 16 enters the gap between the end 367*a* of the sensor supporting member 367 and the surface of the intermediate transfer belt 16, the toner is attracted or adsorbed by the opposing member 366, or sticks to the surface of the intermediate transfer belt 16 and is scraped out by a cleaner blade 22 in a cleaner housing 63.

In the above-described structure, the opposing member 366 may be inexpensively provided and connected to the sensor supporting member 367 of the patch sensor 27.

Next, an eleventh embodiment of the present invention will be described. Here, components similar to those in the above-described embodiments are designated by the same reference numerals and repetitive explanations will be omitted.

Figure 15:
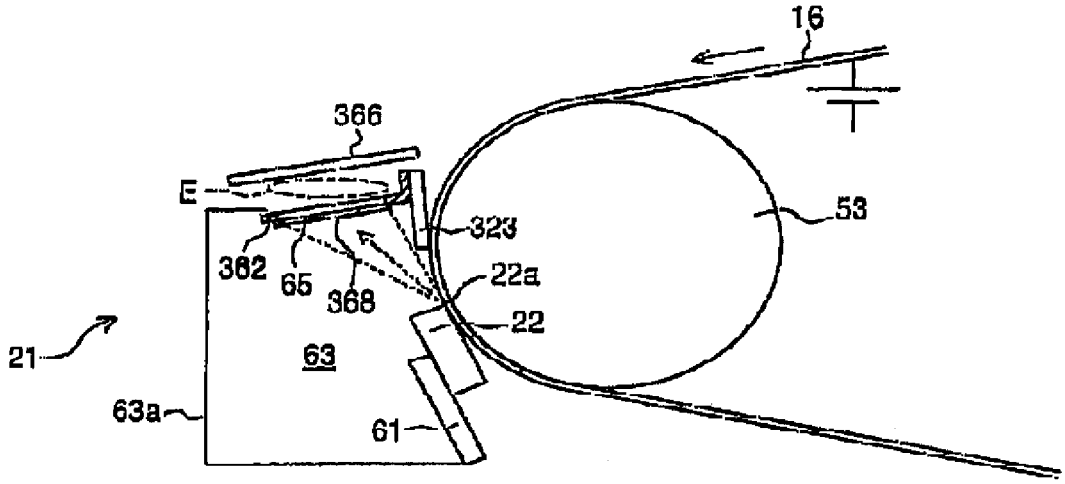
FIG. 15 is a section view of a transfer-side cleaner unit according to an eleventh embodiment of the invention.

As shown in FIG. 15, in this embodiment, a permeable film material (for instance, Mictotex, which is a registered trademark of Nitto Denko Corporation, made of a porous film of ethylene tetrafluoride resin) 368 for restraining floating toner in a cleaner housing 63 from passing and allowing air inside and outside the cleaner housing 63 to pass (vent) is attached to close a vent hole 65 of a seal supporting member 362.

Thus, in a transfer-side cleaner unit 21, since the vent hole 65 opened in the seal supporting member 362 is closed by the permeable film material 368, the air inside and outside the cleaner housing 63 is not prevented from being vented. Even when the floating toner of a toner cloud generated in the cleaner housing 63 is attracted by an electric field E between the seal supporting member 362 and an opposing member 366, the toner is restrained from passing to be caught.

Next, a twelfth embodiment of the present invention will be described. Here, components similar to those in the above-described embodiments are designated by the same reference numerals and repetitive explanations will be omitted.

Figure 16:
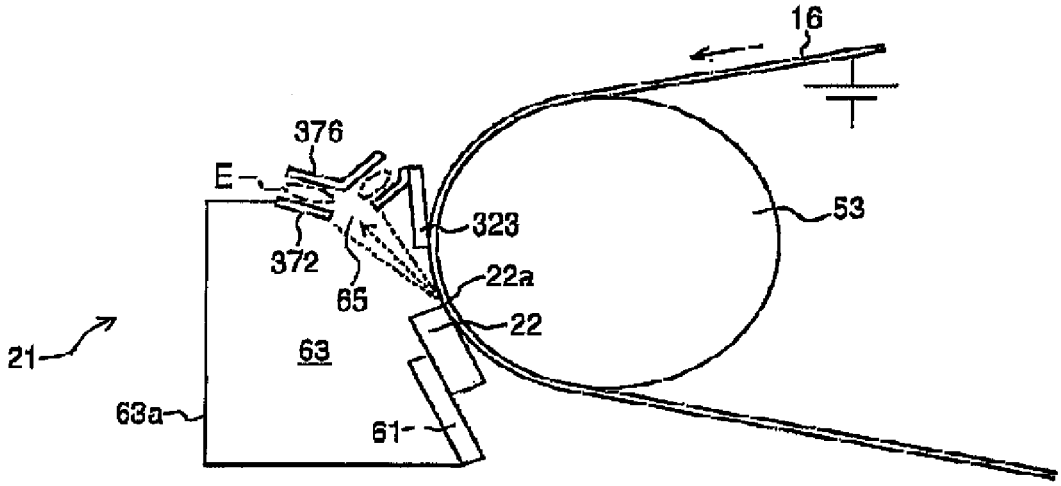
FIG. 16 is a section view of a transfer-side cleaner unit according to a twelfth embodiment of the invention.

As shown in FIG. 16, in this embodiment, a seal supporting member 372 is disposed that is formed in an inclined shape recessed inward of a cleaner housing 63. A vent hole 65 is opened in the bottom part of the recessed part. Further, an opposing member 376 is disposed so as to have a shape corresponding to the recessed part of the seal supporting member 372.

In an area in the inner part of the vent hole 65 of the seal supporting member 362 of the above-described embodiments, since the electric field E is formed between the edge of the vent hole 65 and the opposing member 366 facing the vent hole 65, lines of magnetic force are thick in the periphery of the vent hole 65. In other words, a field intensity in the peripheral edge side of the vent hole 65 is strong so that the toner passing through the vent hole 65 is adapted to be attracted and adsorbed to the peripheral edge side.

In this embodiment, the inclined form of the peripheral edge of the vent hole 65 of the seal supporting member 372 faces substantially in parallel with the recessed form of the opposing member 376 so that an electric filed E having an equal field intensity between them can be generated. Further, since the opposing member 376 having the recessed form is located in the vent hole 65 of the seal supporting member 372 or the inner part of the inclined form, when a sealing member 323 is separated from the surface of an intermediate transfer belt 16 (the supply of voltage to the seal supporting member 372 is shut off) and adsorbed toner is simultaneously recovered to the cleaner housing 63 by shutting off the application of voltage from a power source 28, the toner can be effectively guided and dropped to the vent hole 65 due to the inclined form and recovered to the cleaner housing 63 without leaving the cleaner on the upper face of the seal supporting member 372.

Next, a thirteenth embodiment of the present invention will be described. Here, components similar to those in the above-described embodiments are designated by the same reference numerals and repetitive explanations will be omitted.

Figure 17:
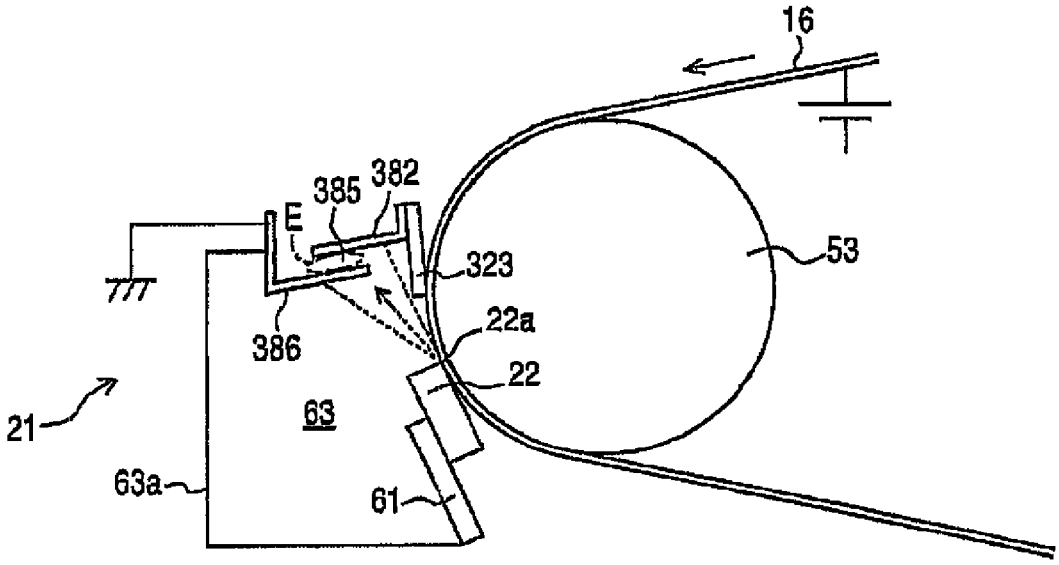
FIG. 17 is a section view of a transfer-side cleaner unit according to a thirteenth embodiment of the invention.

As shown in FIG. 17, in this embodiment, a seal supporting member 382 is disposed that has no vent hole 65 opened. An opposing member 386 is disposed so as to be located in the lower part of the seal supporting member 382 in a side separate from a sealing member 323.

The opposing member 386 is designed to closely face the lower face of the seal supporting member 382 in such an attitude parallel thereto to define a vent hole 385 for allowing air inside and outside a cleaner housing 63 to be vented. Further, the opposing member 386 is designed to be connected to an earth to have zero potential. Here, a case that the opposing member 386 is attached so as to move integrally with the seal supporting member 382 is described. However, the seal supporting member 382 may be attached to the opposing member 386 as a separately operating member.

In this embodiment, between the seal supporting member 382 and the opposing member 386, the vent hole 385 for ensuring gas permeability to an external part is defined. Since the opposing member 386 of zero potential is located in the lower face side of the seal supporting member 382 of a positive potential, an electric field E in which the seal supporting member 382 attracts and adsorb toner of a negative potential is generated between the seal supporting member 382 and the opposing member 386 without performing a control for applying voltage to the opposing member 386 by the CPU 42 of an engine controller 46. That is, a voltage applying circuit is not required. Further, under an attitude that the seal supporting member 382 pivots the sealing member 323 to be separated from the surface of an intermediate transfer belt 16, the seal supporting member 382 can incline the vent hole 365 (the lower face of the seal supporting member 382 or the upper face of the opposing member 386) together with the opposing member 386 to be directed to the cleaner housing 63.

Thus, in a transfer-side cleaner unit 21, when the sealing member 323 is separated from the surface of the intermediate transfer belt 16 (the supply of voltage to the seal supporting member 382 is shut off), toner adsorbed to the lower face of the seal supporting member 382 can be simultaneously effectively guided and dropped to the cleaner housing 63 by the upper face of the opposing member 386 and recovered without leaving the toner on the upper face of the opposing member 386.

Further, in the transfer-side cleaner unit 21, since the vent hole 385 is opened in the direction bent relative to the flying direction of the toner scraped and scattered from the surface of the intermediate transfer belt 16, the toner does not pass through the vent hole 385 and the flying toner can be attracted and adsorbed on the lower face side of the seal supporting member 382 to be caught and recovered by, what is called a labyrinth effect.

In this embodiment, the opposing member 386 is connected to the earth and set to the zero potential to form the electric field E between the seal supporting member 382 and the opposing member 386. However, a positive voltage higher than that of the intermediate transfer belt 16 may be supplied to the opposing member 386 to generate an electric field for attracting and adsorbing toner of a negative potential. In this case, since the toner is adsorbed to the lower opposing member 386 side, such a structure as this embodiment is preferable. Further, negative voltage may be supplied to an opposing member 386 to generate an electric field E for attracting and adsorbing floating toner on the lower face side of a seal supporting member 382 similarly to this embodiment. In this case, the intensity of the electric field E can be more increased than the structure of this embodiment. However, since the above-described structure is not simpler than the structure in which the opposing member is merely connected to the earth, either of them may be selected depending on circumstances.

Next, a fourteenth embodiment of the present invention will be described. Here, components similar to those in the above-described embodiments are designated by the same reference numerals and repetitive explanations will be omitted.

Figure 18:
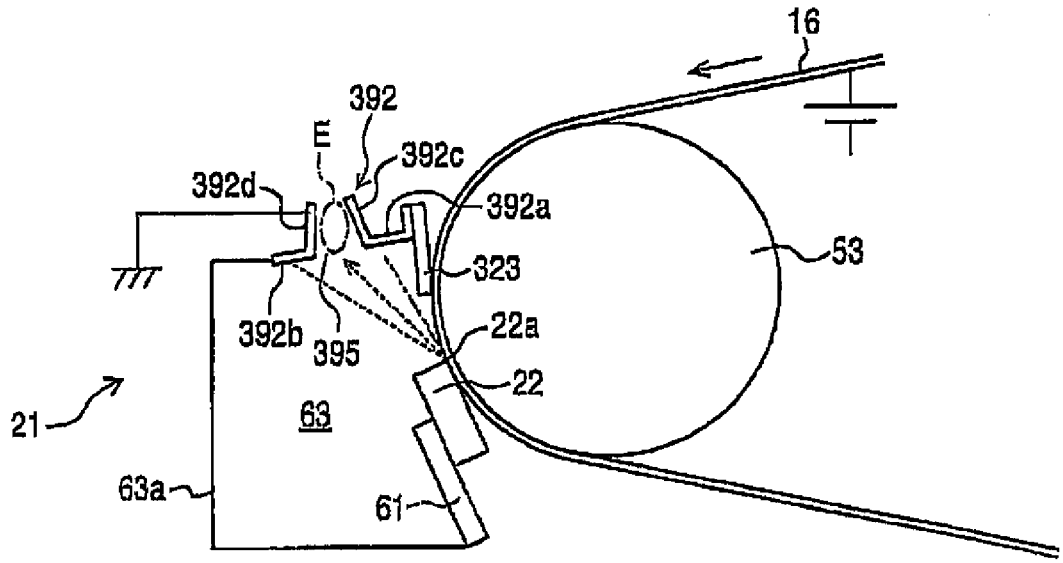
FIG. 18 is a section view of a transfer-side cleaner unit according to a fourteenth embodiment of the invention.

As shown in FIG. 18, in this embodiment, a seal supporting member 392 is disposed so as to project to the outside of a cleaner housing 63 and has a vent hole 395.

The seal supporting member 392 is divided into a support part 392*a* for supporting a sealing member 323 and a rear end part 392*b* being separated from the sealing member 323 than the vent hole 395 and assembled so as to integrally move. The projected parts 392*c* and 392*d* of the support part 392*a* and the rear end part 392*b* face each other through the vent hole 395. The rear end part 392*b* is connected to an earth and set to a zero potential. Here, a case that the seal supporting member 392 is formed with the support part 392*a* and the rear end part 392*b* operating integrally is described. However, the support part 392*a* may move, whereas the rear end part 392*b* may be provided as a fixed separate member. In this case, when the support part 392*a* is pivoted so that the sealing member 323 is allowed to come into slide contact with the surface of an intermediate transfer belt 16, the projected part 392*c* of the support part 392*a* is disposed to closely face the projected part 392*d* of the rear end part 392*b*.

In this embodiment, the vent hole 395 for ensuring a gas permeability relative to an external part is defined between the projected parts 392*c* and 392*d* of the support part 392*a* and the rear end part 392*b* of the seal supporting member 392. The rear end part 392*b* of zero potential is opposed to the support part 392*a* of a positive potential so as to face the projected parts 392*c* and 392*d* each other, so that an electric field E in which the projected part 392*c* of the support part 392*a* attracts and adsorbs toner of a negative potential is generated without performing a control for applying voltage to the rear end part 392*b* by the CPU 42 of an engine controller 46. That is, a voltage applying circuit is not required. Further, since the projected parts 392*c* and 392*d* of the seal supporting member 392 define the vent hole 395 opened vertically and the upper parts thereof are the closer to each other to increase a field intensity, the toner scraped and scattered from the surface of the intermediate transfer belt 16 can be attracted and adsorbed to the projected part 392*c* of the support part 392*a* without ejecting the toner from the vent hole 395. When the sealing member 323 is separated from the surface of the intermediate transfer belt 16 (the supply of voltage to the support part 392*a* of the seal supporting member 392 is shut off), the toner adsorbed to the inner surface of the projected part 392*c* of the support part 392*a* is simultaneously dropped in the cleaner housing 63 and recovered.

In this embodiment, the seal supporting member 392 is set to the positive potential through the sealing member 322 by using the positive potential supplied to the intermediate transfer belt 16. However, the seal supporting member may be formed with an insulative film material. Further, the seal supporting member may be designed to be separately grounded or a voltage may be applied to the sealing member to generate an electric field.

Next, a fifteenth embodiment of the present invention will be described. Here, components similar to those in the above-described embodiments are designated by the same reference numerals and repetitive explanations will be omitted.

Figure 19:
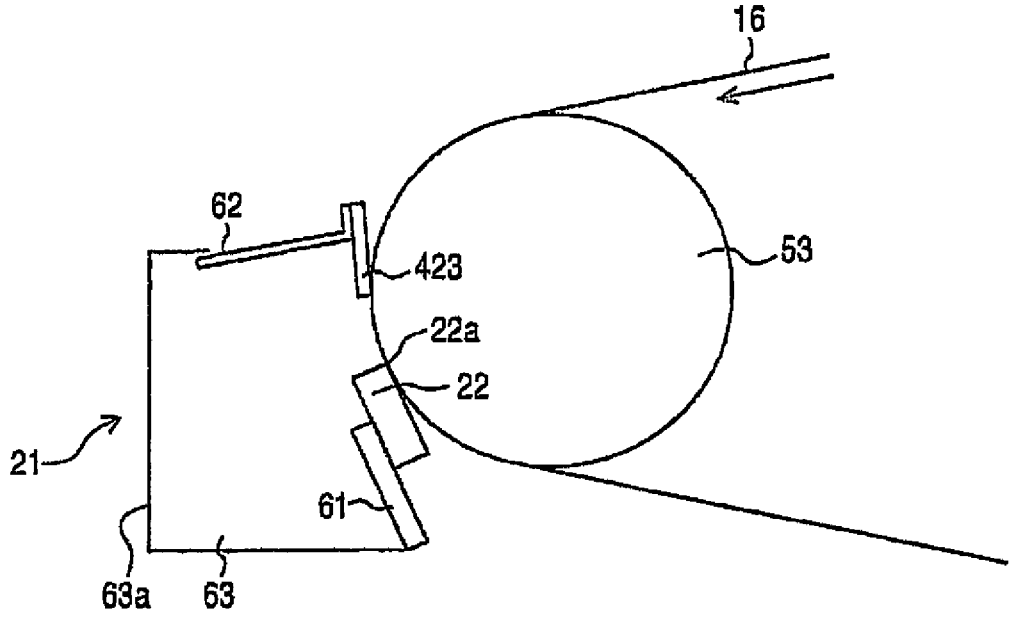
FIG. 19 is a section view of a transfer-side cleaner unit according to a fifteenth embodiment of the invention.

As shown in FIG. 19, in this embodiment, a cleaner blade 22, a sealing member 423, a blade supporting member 61 and a seal supporting member 62 form a part of a housing defining member 63*a* for defining the outer face of a cleaner housing 63. The sealing member 423 is made of a permeable film material (for instance, Mictotex, which is a registered trademark of Nitto Denko Corporation, made of a porous film of ethylene tetrafluoride resin) for restraining floating toner in the cleaner housing 63 from passing and allowing air inside and outside the cleaner housing 63 to pass (vent).

Thus, an air flow dragged on the surface of an intermediate transfer belt 16 that passes a slide contact position between the sealing member 423 and the surface of the intermediate transfer belt to enter the cleaner housing 63 has hitherto acted to raise internal pressure in the cleaner housing 63. However, here, the toner of a toner cloud generated in the cleaner housing 63 is not allowed to pass and the air flow can be ejected outside from the sealing member 423 so that a pressure difference does not arise inside and outside the cleaner housing 63 and the internal pressure is not raised.

Accordingly, when the cleaner blade 22 or the sealing member 423 is separated from the surface of the intermediate transfer belt 16 so that an inner part of the cleaner housing 63 communicates with an outer part, a large quantity of toner cloud (floating toner) can be prevented from being jetted together with air in the cleaner housing 63 from a gap between the surface of the intermediate transfer belt 16 and the sealing member 423 to contaminate the outer part of the device with the toner. Further, even when the seal supporting member 62 or the blade supporting member 61 is pivoted so as to reduce a volume in the cleaner housing 63 in order to separate the sealing member 423 or the cleaner blade 22 from the surface of the intermediate transfer belt 16, since the cleaner housing 63 is not pressurized, an excessive pressure variation can be prevented from being instantaneously generated. Further, the air or the toner cloud (floating toner) in the cleaner housing 63 can be prevented from being jetted from the gap formed by the sealing member 423 or the cleaner blade 22 separating from the surface of the intermediate transfer belt 16 in accordance with the rise of the pressure due to the pressure variation.

Therefore, the floating toner does not stick to the parts of peripheral devices to contaminate them with the toner. For instance, the toner can be prevented from sticking to a detecting part of a patch sensor 27 which makes it impossible to detect the precise density of the toner. Further, the toner can be prevented from adhering and remaining in the image forming area of the intermediate transfer belt 16 to mix colors and deteriorate the quality of an image or the floating toner can be prevented from adhering to the periphery of a transfer-side cleaner unit 21 which makes a maintenance work difficult.

Next, a sixteenth embodiment of the present invention will be described. Here, components similar to those in the above-described embodiments are designated by the same reference numerals and repetitive explanations will be omitted.

Figure 20:
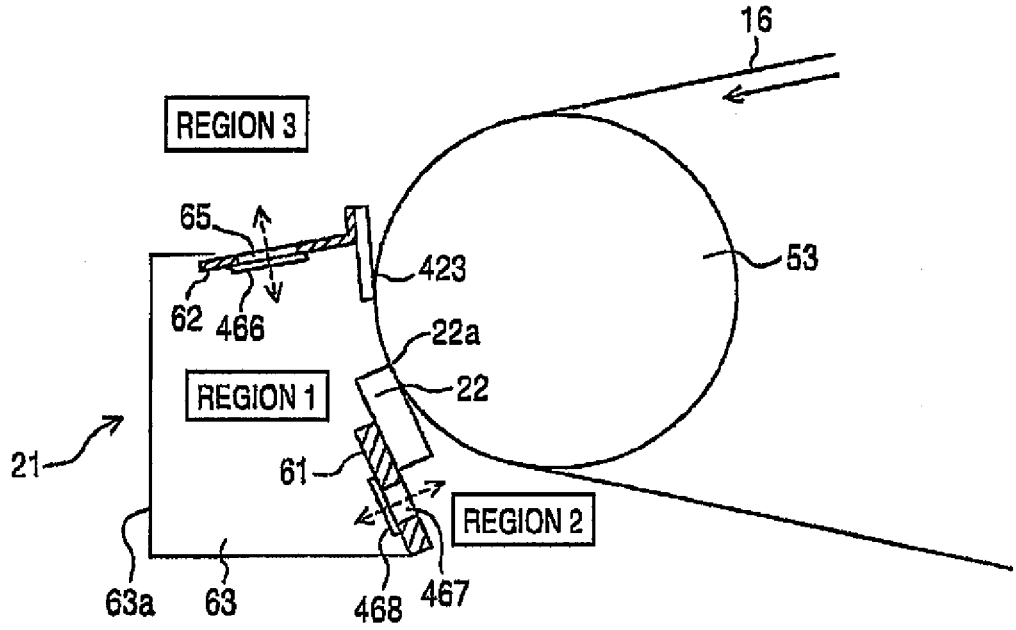
FIG. 20 is a section view of a transfer-side cleaner unit according to a sixteenth embodiment of the invention.
Figure 21:
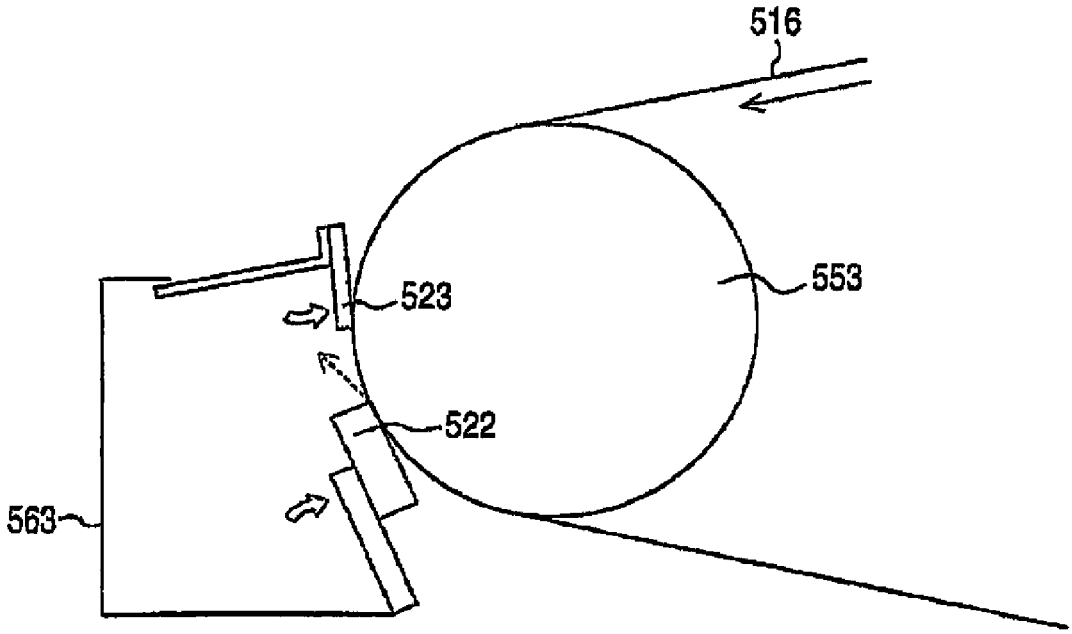
FIG. 21 is a section view of a related-art transfer-side cleaner unit.

As shown in FIG. 20, in this embodiment, a vent hole 65 extending in the width direction of an intermediate transfer belt 16 is opened in a seal supporting member 62 for supporting a sealing member 423. To the vent hole 65, a permeable film material 466 is attached for restraining floating toner in a cleaner housing 63 from passing and allowing air inside and outside the cleaner housing 63 to pass (vent), like the sealing member 423.

Further, a vent hole 467 extending in the width direction of the intermediate transfer belt 16 is similarly opened in a blade supporting member 61 for supporting a cleaner blade 22. To the vent hole 467, a permeable film material 468 is also attached for restraining the floating toner in the cleaner housing 63 from passing and allowing air inside and outside the cleaner housing 63 to pass (vent).

In a side (region 2) where the blade supporting member 61 is disposed, since an exhaust duct 24*a* as a suction port of an exhausting unit 26 is opened in the vicinity thereof, a pressure difference is apt to arise relative to an inner part of the cleaner housing 63 (region 1). The pressure of the region 2 outside the cleaner housing 63 may be possibly liable to be reduced more than that of the region 1 in the cleaner housing 63 to have a negative pressure. Further, in a side where the seal supporting member 62 is disposed (region 3), the pressure difference is similarly apt to arise relative to the inner part of the cleaner housing 63 (region 1) due to the influence of a suction by the exhaust duct 24*a* of the exhausting unit 26. The pressure of the region 3 outside the cleaner housing may be possibly liable to be reduced more than that of the region 1 in the cleaner housing 63 to have a negative pressure.

Thus, in a transfer-side cleaner unit 21, since the vent holes 65 and 467 are opened in the seal supporting member 62 or the blade supporting member 61 and closed by the permeable film materials 466 and 468, the floating toner of a toner cloud generated in the cleaner housing 63 is prevented from passing and air is allowed to pass between the region 1 and the areas 2 and 3 to prevent the pressure difference from arising. Further, even when the seal supporting member 62 or the blade supporting member 61 is rotated so as to reduce a volume in the cleaner housing 63 in order to separate the sealing member 423 or the cleaner blade 22 from the surface of the intermediate transfer belt 16, the vent holes 65 and 467 can effectively allow the air in the cleaner housing 63 to pass (vent) so that a large pressure variation can be prevented from being instantaneously generated. Further, the air or the toner cloud (floating toner) in the cleaner housing 63 can be more prevented from being jetted from a gap formed by the sealing member 423 or the cleaner blade 22 separating from the surface of the intermediate transfer belt 16 in accordance with the rise of the pressure due to the pressure variation.

According to the above-described structure, in the areas 1 and 3 where the sealing member 423 is disposed, a gas permeability can be further improved and in the areas where the cleaner blade 22 is disposed, a gas permeability can be also ensured. Accordingly, the floating toner of the toner cloud generated due to the slide contact of the cleaner blade 22 with the surface of the intermediate transfer belt 16 can be further reliably prevented from being jetted when the cleaner blade 22 or the sealing member 423 is separated from the intermediate transfer belt 16.

Although only some exemplary embodiments of the invention have been described in detail above, those skilled in the art will readily appreciated that many modifications are possible in the exemplary embodiments without materially departing from the novel teachings and advantages of the invention. Accordingly, all such modifications are intended to be included within the scope of the invention.

The disclosure of Japanese Patent Application Nos. 2005-293328 filed Oct. 6, 2005; 2005-293329 filed Oct. 6, 2005; 2005-293330 filed Oct. 6, 2005; 2005-293331 filed Oct. 6, 2005; and 2005-293332 filed Oct. 6, 2005, including specifications, drawings and claims is incorporated herein by reference in their entirety.

What is claimed is:

1. An image forming apparatus, comprising:

a first rotary image carrier, adapted to support a toner image obtained by developing an electrostatic latent image formed thereon;

a second rotary image carrier, adapted to support, on a toner supporting face thereof, the toner image which has been primarily transferred from the first rotary image carrier and is to be secondarily transferred onto a recording medium;

a cleaner housing, having wall members defining a housing space, a first one of which is formed with a first ventilation hole;

a blade member, disposed in the housing space and configured to separatably come in contact with the second rotary image carrier to scrape off toner remaining thereon;

a sealing member, disposed in the housing space and configured to separatably come in contact with the second rotary image carrier to form a closed space together with the blade member; and an air duct, a part of which is formed by an outer face of at least one of the wall members of the cleaner housing, and communicating with the housing space through the first ventilation hole, wherein:

the first ventilation hole is provided at a position opposing a tip end of the blade member when the blade member comes in contact with the second rotary image carrier;

a cleaner angle is defined as an angle between an extending direction of a tip end portion of the blade member when the blade member comes in contact with the second rotary image carrier and a tangential line of the second rotary image carrier at the position that the blade member comes in contact with the second rotary image carrier; and the first ventilation hole intersects the tangential line and a line extending in a direction angled from the tangential line by at least the cleaner angle.

2. The image forming apparatus as set forth in claim 1, wherein:

the air duct is an exhausting duct of the image forming apparatus.

3. The image forming apparatus as set forth in claim 1, further comprising:

a toner flow limiter, provided in the air duct and adapted to limit a flow of toner flowing out of the housing space.

4. The image forming apparatus as set forth in claim 3, wherein:

the toner flow limiter is a filter adapted to catch toner.

5. The image forming apparatus as set forth in claim 3, wherein:

the toner flow limiter is an electric field generator operable to generate an electric field adapted to attract toner in the housing space, and to cause the absorbed toner to be attached on an inner face of the air duct.

6. The image forming apparatus as set forth in claim 5, wherein:

the sensor support member comprises a plate member extending toward the toner supporting face of the second rotary image carrier.

7. The image forming apparatus as set forth in claim 3, wherein:

the toner flow limiter is an electric field generator operable to generate an electric field adapted to prevent toner within the cleaner housing from passing through the first ventilation hole.

8. The image forming apparatus as set forth in claim 1, further comprising:

a sensor, disposed in an upstream side of the cleaner housing relative to a rotary direction of the second rotary image carrier, and operable to detect a density of toner on the second rotary image carrier;

a sensor support member, disposed in the vicinity of the first ventilation hole and supporting the sensor; and a plate member, provided with the support member and forming a part of the air duct.

9. The image forming apparatus as set forth in claim 1, further comprising:

a seal support member, supporting the seal member and forming a part of the first one of the wall members of the cleaner housing.

10. The image forming apparatus as set forth in claim 1, further comprising:

a filter, covering the first ventilation hole and adapted to catch toner.

11. The image forming apparatus as set forth in claim 1, further comprising:

a plate member, provided in the housing space and extending toward the first ventilation hole.

12. The image forming apparatus as set forth in claim 11, further comprising:

a seal support member, supporting the seal member and forming a part of the first one of the wall members of the cleaner housing formed with the first ventilation hole; and a blade support member, disposed in the housing space and supporting the blade member, wherein:

the plate member is provided with at least one of the seal support member and the blade support member.

13. The image forming apparatus as set forth in claim 1, wherein:

a second one of the wall members of the cleaner housing is formed with a second ventilation hole communicating the air duct and the housing space therethrough.

14. The image forming apparatus as set forth in claim 13, wherein:

the second ventilation hole is formed at such a position that a line connecting the first ventilation hole and the second ventilation hole becomes a tangential line of the second rotary image carrier.

15. The image forming apparatus as set forth in claim 14, further comprising:

a plate member extending in a direction parallel to the line connecting the first ventilation hole and the second ventilation hole.

16. The image forming apparatus as set forth in claim 13, further comprising:

a filter, covering the second ventilation hole and adapted to catch toner.

* * * * *